US005921337A

United States Patent [19]

Okamoto

[11] Patent Number: 5,921,337

[45] Date of Patent: Jul. 13, 1999

[54] SLOPE WORKING MACHINERY

[76] Inventor: Toshihito Okamoto, 2695 Kaneda, Chosei-son, Chosei-gun, Chiba-ken, Japan

[21] Appl. No.: 08/868,358

[22] Filed: Jun. 3, 1997

[51] Int. Cl.[6] ..... B60G 17/04

[52] U.S. Cl. ..... 180/41; 180/901; 280/6.154

[58] Field of Search ..... 180/41, 901; 280/6.154

[56] References Cited

U.S. PATENT DOCUMENTS 4,365,927 12/1982 Schenck ..... 180/41

4,991,673 2/1991 Ericsson ..... 180/41

*Primary Examiner*—Kenneth R. Rice

*Attorney, Agent, or Firm*—Jordan and Hamburg, LLP

[57] ABSTRACT

A slope working machinery which moves and travels safely on the slope has a suspension device having at least one of a winch and a driving device attached to a body thereof, has a work stand to work on the working machine capable of keeping nearly horizontally and to use to carry bagagges, whereby working on a steep slope can be conducted with much ease and safe.

20 Claims, 47 Drawing Sheets

SLOPE WORKING MACHINERY

BACKGROUND OF THE INVENTION

The present invention relates to a slope working machinery for use in various applications, such as the carrying of baggage and/or working with machines, for example, an oil hydraulic machine, on a slope.

A known application directed to work on a slope using machines such as oil hydraulic machines has many problems attendant therewith, requiring intensive labor and time consuming effort with regard to establishment of a scaffold. The cost has heretofore been very high and there have been difficulties encountered in order to establish a scaffold on a slope and carry the oil hydraulic machines to a slope by using the established scaffold.

SUMMARY OF THE INVENTION

For the purpose of overcoming the foregoing disadvantages, it is an object of the present invention to provide improved slope working machinery capable of moving safely and with much greater ease on the slope so that the carrying of baggage and/or working with a machine, for example, oil hydraulic devices, on a slope can be conducted safely and reliably, and at higher efficiency.

Other objects and novel features of the present invention will be apparent from reading of the detailed description in conjunction with the drawings.

The accompanied drawings are provided for illustrative purposes, and are not meant to limit the scope of the present invention.

DESCRIPTION OF THE PREFERRED EMBODIMENT

Figure 1:
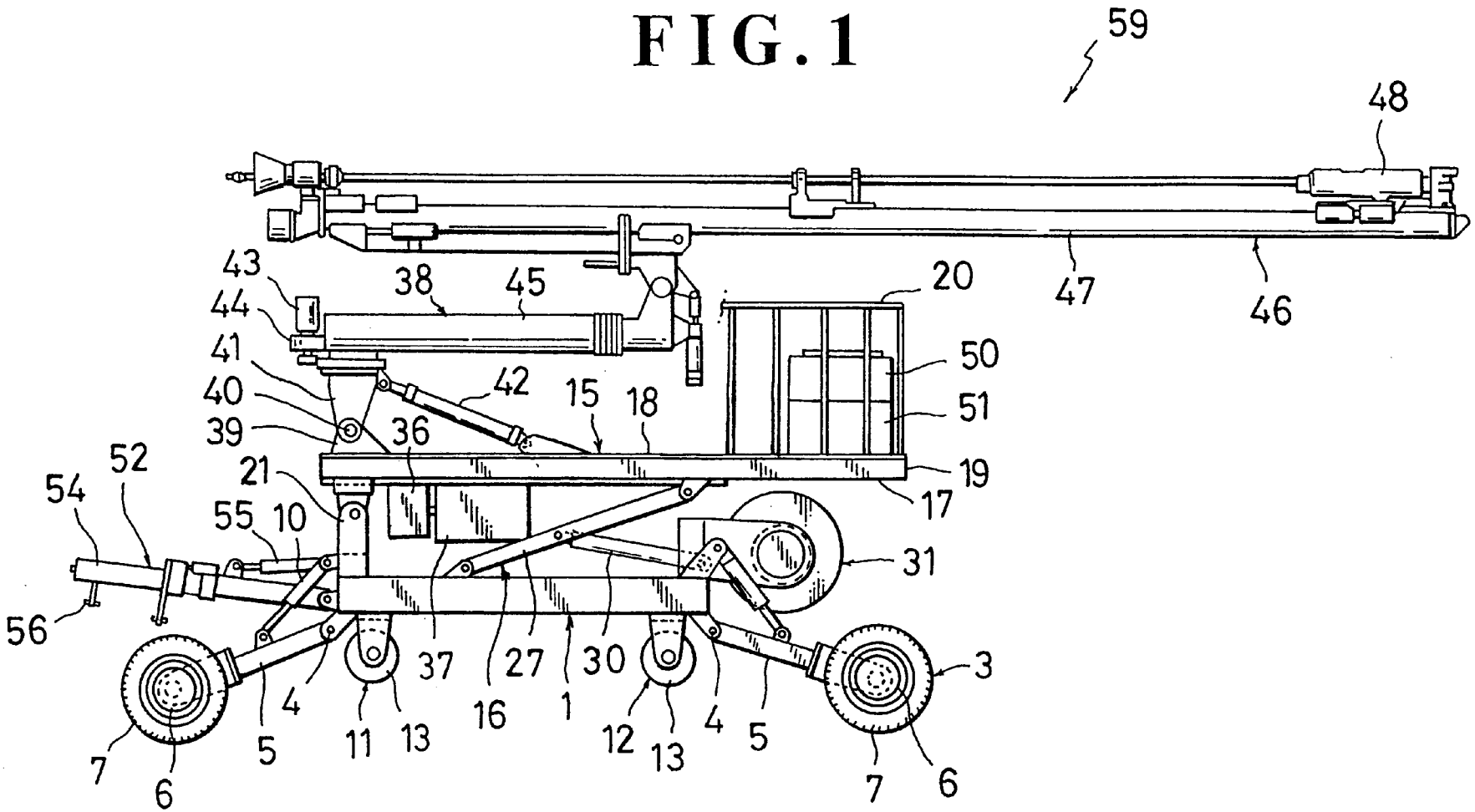
FIG. 1 is a side view showing a first embodiment of the present invention.
Figure 2:
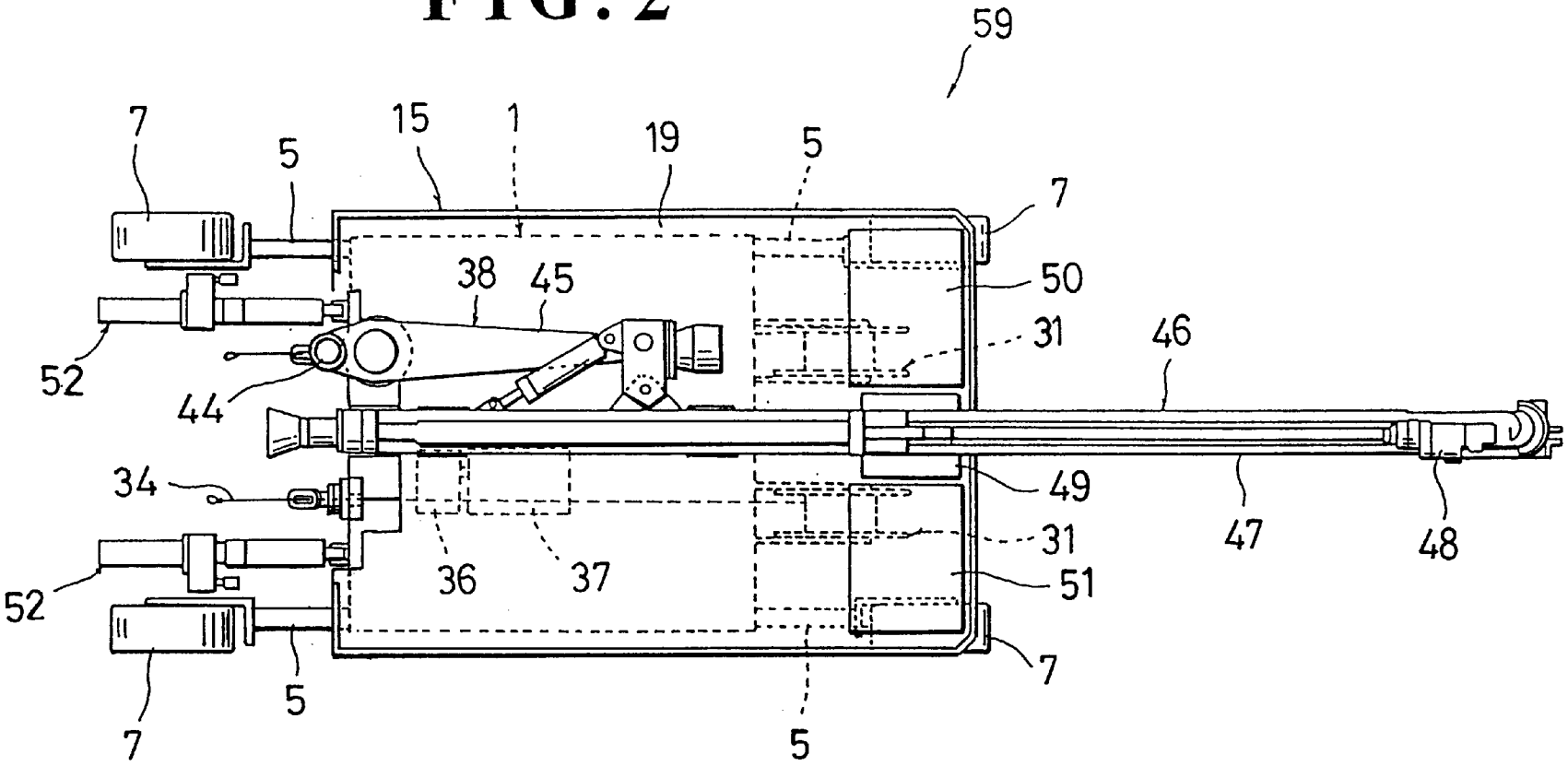
FIG. 2 is a plan view showing a first embodiment of the present invention.
Figure 3:
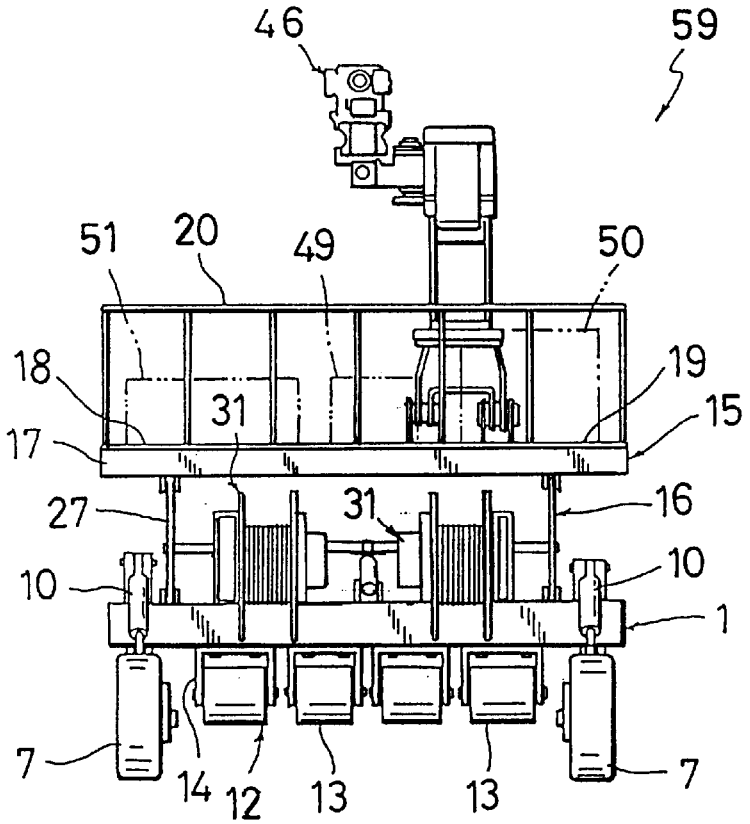
FIG. 3 is a back view showing a first embodiment of the present invention.
Figure 4:
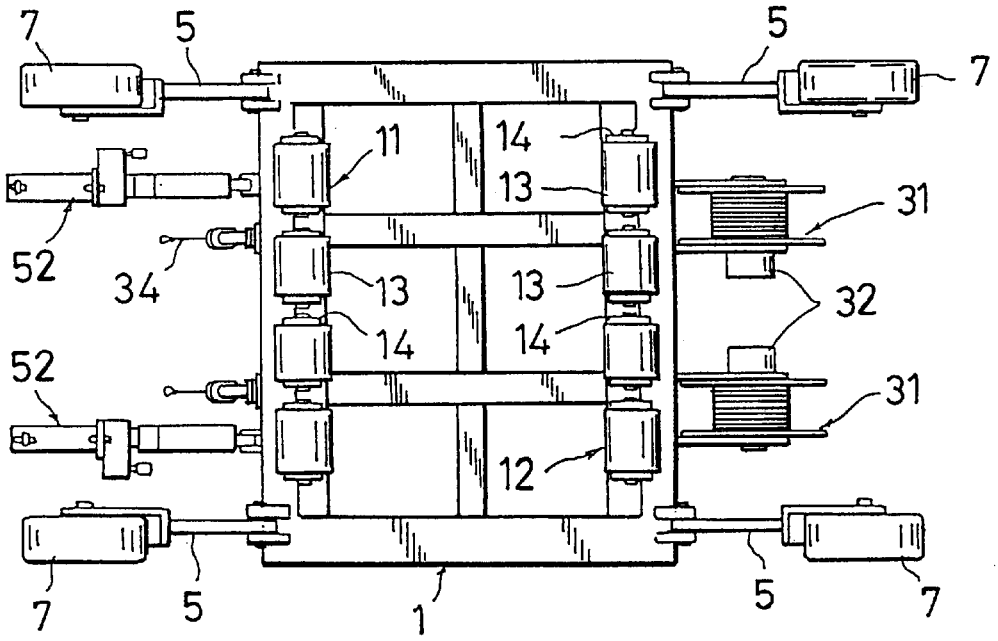
FIG. 4 is a bottom view showing a first embodiment of the present invention.

Preferred embodiments of the present invention will be described in detail referring to the accompanying drawings.

FIGS. 1 to 11 illustrate a first embodiment of the present invention in which are a body 1 having a running device 3 capable of travelling on a frame 2 of a slope. The body 1 has hard structure made of a steel materials.

The running device 3 comprises four wheel support arms 5, 5, 5, 5, four driving tire-wheels 7, 7, 7, 7, and four oil hydraulic cylinders for the wheels 10, 10, 10, 10. The wheel support arms 5, 5, 5, 5 are pivotably mounted to the bottom of front, rear, left, and right portion of the body 1, by four pivot pins 4, 4, 4, 4, thereby permitting the wheel support arms 5, 5, 5, 5 to move upward and downward. The four driving tire-wheels 7, 7, 7, 7 are mounted to the end part of the wheel support arms 5, 5, 5, 5 and are driven by four oil hydraulic motors for the wheels 6, 6, 6, 6. The four oil hydraulic cylinders for the wheels 10, 10, 10, 10 can be operated to pivot each of the four wheel support arms 5, 5, 5, 5. The cylinders for the wheels 10, 10, 10, 10 are pivotably mounted at one end to the upper part of front, rear, left, and right portions of the body by four pivot pins 8, 8, 8, 8 and pivotably mounted at the other end to the four wheel support arms 5, 5, 5, 5 by four pivot pins 9, 9, 9, 9 in a nearly centered position.

Front-rear preventive rollers for fall off-wheels 11, 12 for travelling on the frame 2 are mounted to the bottom of nearly front and rear positions of the body 1. The front-rear preventive rollers for fall off-wheels 11, 12 comprise a roller 13 and a plurality of roller support clasps 14, the depicted embodiment using four roller support clasps arranged in parallel. The four roller support clasps 14 are provided to the roller 13, each of the roller support clasps 14 being mounted to the bottom of the body 1 at fixed spaces.

A work stand 15 is mounted, through a work stand support device 16 the center of gravity of which is movable to the upper part of the frame 2 of a slope, to the upper part of the body 1 and which may be pivoted nearly horizontally when the body 1 is positioned on the frame 2 of a slope. The work stand 15 comprises a work stand body 19 and a fence 20. The work stand body 19 formed by fixably welding a steel board 18 to a frame 17 formed of a steel materials. The fence 20 covers the outer part at the upper part of the work stand body 19.

The work stand support device 16 is comprised of props 21, 21, sustainings 24, 24, support arms 27, 27, a connected arm 28, and an oil hydraulic cylinder for pivoting of the work stand 30. The props 21, 21 are fixed in a position a little to both sides of the front of the body 1. The sustainings 24, 24 are attached to the upper part of the props 21, 21, each prop 21 being able to pivot by pivot pins 22, 22. The sustainings 24, 24 are supported by slide rails 23, 23 formed at the bottom part at both sides of the front part of the work stand 15, and are slidable along the slide rails 23, 23. Also, the support arms 27, 27 are pivoted, the lower parts thereof being pivoted by pivot pins 25, 25 to both sides of the front part rather than the center part of the body 1, and the upper parts thereof being pivoted by pivot pins 26, 26 to both sides of the back part rather than the center part of the work stand 15. Moreover, both side parts of the connected arm 28 is fixed to the nearly center part of the support arms 27, 27. In addition, the oil hydraulic cylinder for pivoting of the work stand 30 is pivotable, one end thereof being pivotably mounted to the nearly center part of the connected arm 28, and another end thereof being pivotably mounted by a pivot pin 29 to the nearly center of the rear part of the body 1.

Left and right winches 31, 31, each which function as a suspension device, include drums 33, 33, each which can be revolved by oil hydraulic motors for the winches 32, 32 mounted to the rear part of the body 1 as to jut out backward thereof. Also, the left and right winches 31, 31 are used to safely maintain the body 1 on the frame 2 at the slope by mounting wires 34, 34 rolled up on the drums 33, 33 of the winches 31, 31 to left and right anchor pins 35, 35 fixed to left and right portions of the upper position of the used slope.

Additionally, in this embodiment, wire clasp mounted wires 34, 34 of winches 31, 31 arranged at the upper position of the frame 2 on the slope may be mounted to the body 1 in spite of the left and right winches 31, 31.

An oil hydraulic pump 36 is established at the bottom of the work stand 15 as a driving gear of working device.

A swing boom 38 is mounted to the upper part of the front of the work stand 15 and which is pivotable for-, back-, left-, and rightward. The swing boom 38 is comprised of a support stand 41, an oil hydraulic cylinder for the support stand 42, and a swing boom body 45. The support stand 41 is mounted by a pivot pin 40 to an installed stand 39 jutting out from the upper part in the front of the work stand 15. The oil hydraulic cylinder for the support stand 42 operates to pivot the support stand 41 forward and backward. The swing boom body 45 is mounted to the support stand 41 through a pivot means 44. An oil hydraulic motor for the support stand 43 operates to pivot the swing boom body leftward and rightward.

A hole making device 46 is mounted selectively to the end part of the swing boom 38, capable of making a hole in the frame 2 formed on the slope, and thus forming the working part of the working device. Also, the hole making device 46 is comprised a guide shell 47 and an oil hydraulic drifter 48. The guide shell 47 is mounted to the swing boom 38, and the oil hydraulic 48 is mounted to the guide shell 47.

A battery 49 and/or a fuel tank 50 to work the engine 37 is mounted to the upper part of the work stand 15, and an oil tank for operation to supply the operation oil for the oil hydraulic pump 36 is mounted to the upper part of the work stand 15.

A pair of body lock devices 52, 52 is mounted to the front part of the body 1. Also, the pair of the body lock devices 52, 52 is comprised of fixed arms 54, 54, oil hydraulic cylinders for the fixed arms 55, 55, fixed lock projections 56, 56, movable lock projections 57, 57 and oil hydraulic cylinders for the movable lock projections 58, 58. The fixed arms 54, 54 are pivotably mounted through pivot pins 53, 53 to the front part, except for the center part, of the body 1. The oil hydraulic cylinders for the fixed arms 55, 55 can operate to pivot the fixed arms 54, 54, one end thereof being pivoted to the body 1, and another end thereof being pivoted to the fixed arms 54, 54.

Also the fixed lock projections 56, 56 are fixed as to jut out downward a little to the end of the fixed arms 54, 54. Additionally, the movable lock projections 57, 57 are mounted to the fixed arms 54, 54, slidable therealong. Moreover, the oil hydraulic cylinders for the movable lock projections 58, 58 impart slidable movement to the movable lock projections 57, 57.

Figure 9:
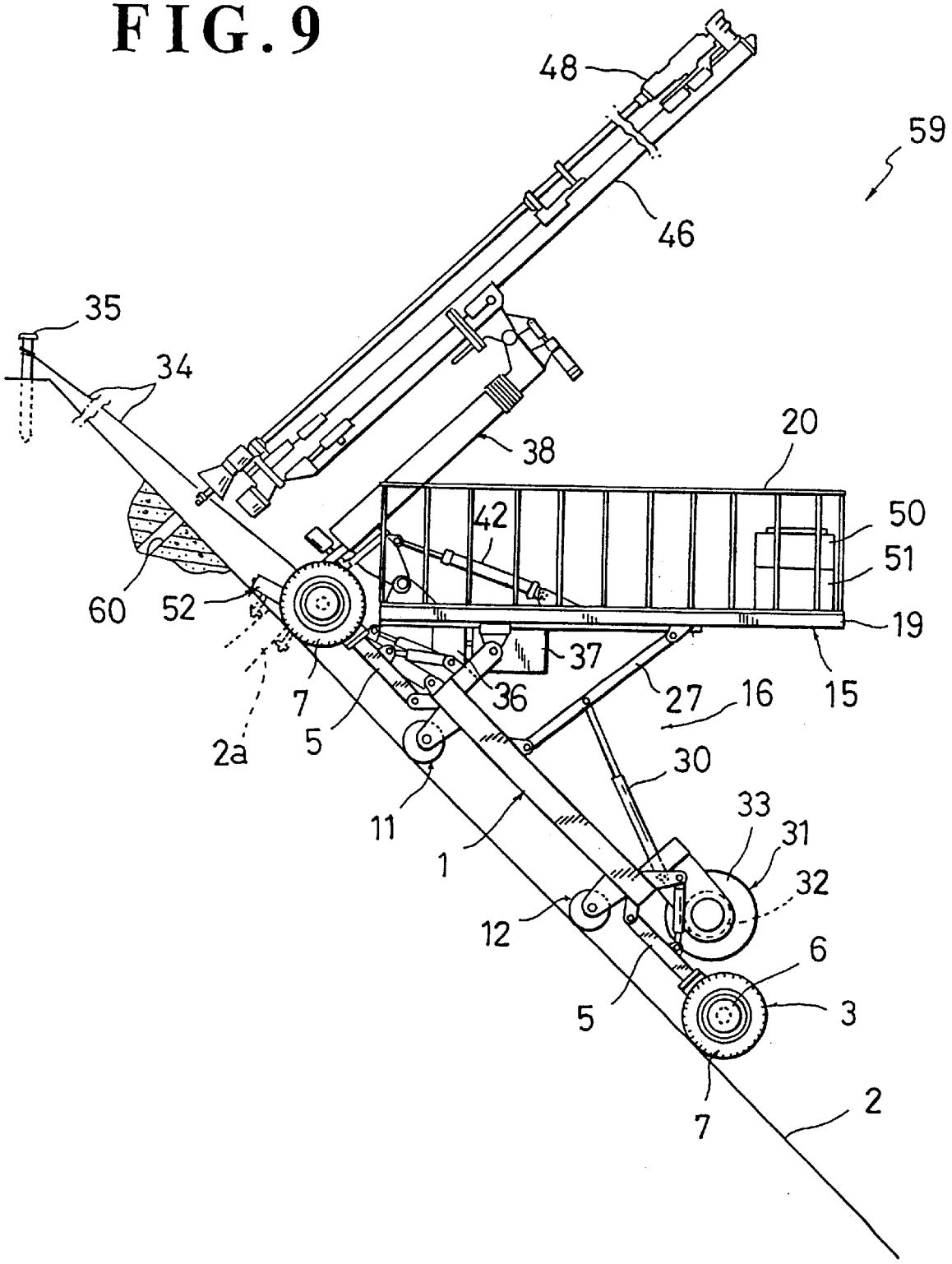
FIG. 9 is an explanatory view of condition for use showing a first embodiment of the present invention.

In use, a slope working machinery 59 having the foregoing arrangement can be made to travel forward and backward by revolving of each of drive wheels 7, 7, 7, 7 driven by the oil hydraulic motors for wheels 6, 6, 6, 6 while the wires 34, 34 of the left and right winches 31, 31 operating as a suspension device are mounted to the left and right anchor pins 35, 35 fixed to the left and right portions of the upper position of a slope being worked, and the oil hydraulic motors for the wheels 6, 6, 6, 6 rolls up the wires 34, 34, as shown in FIG. 9.

Figure 5:
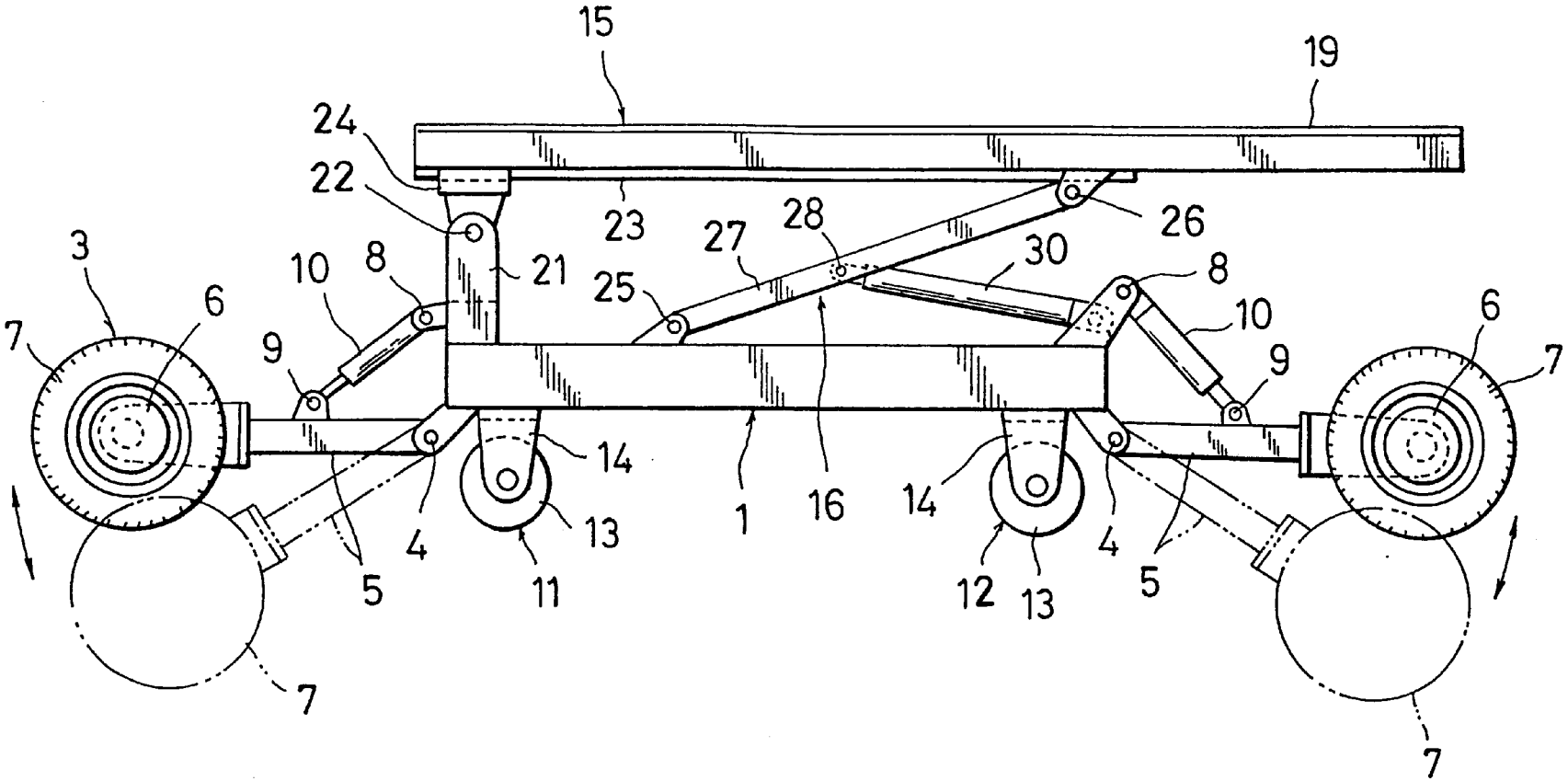
FIG. 5 is an explanatory view for height adjustment of a body showing a first embodiment of the present invention.
Figure 10:
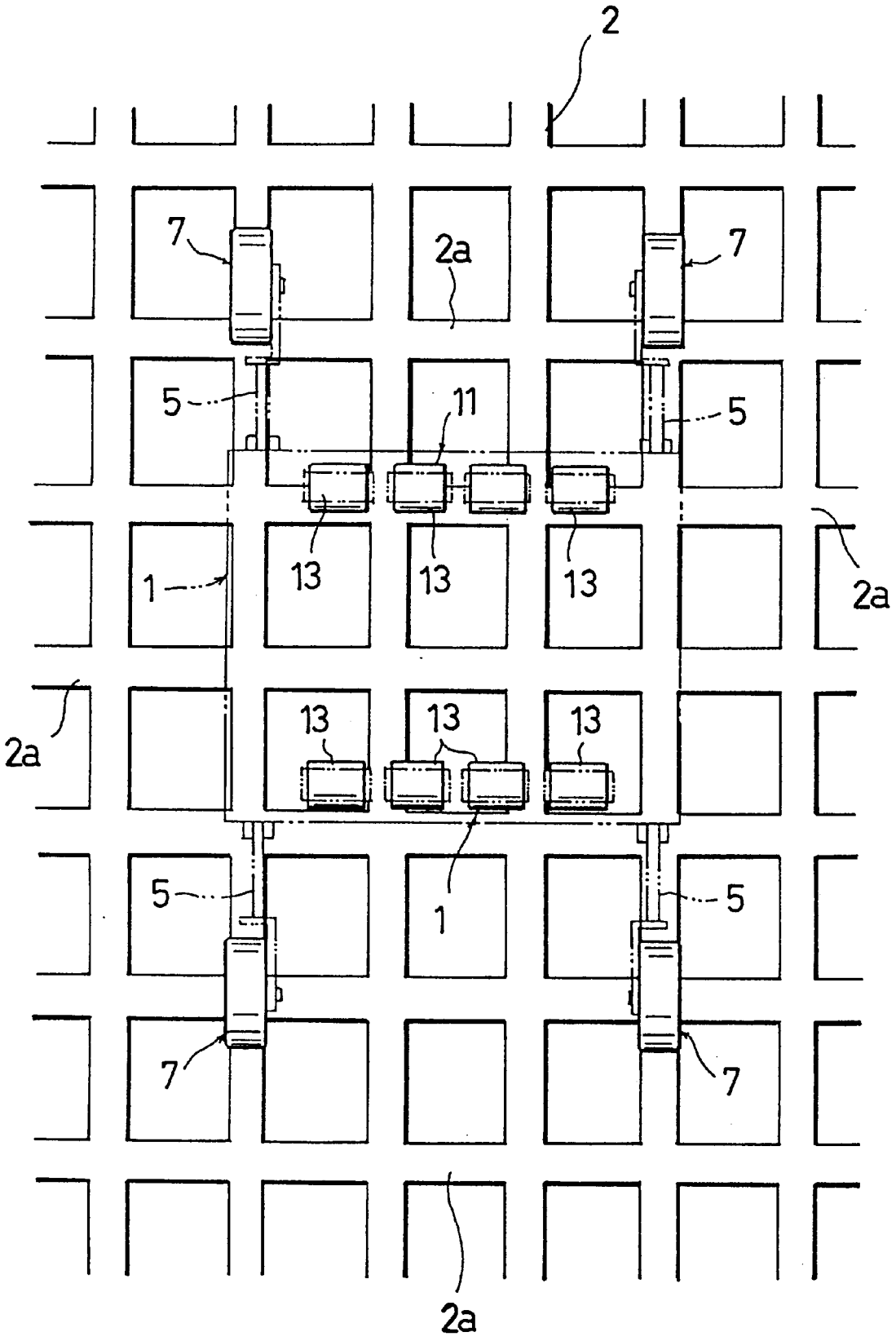
FIG. 10 is an explanatory view illustrating the located relation between a preventive roller for fall off-wheels and driving wheels on a frame in use.

Then, as shown in FIG. 5, the height of the body 1 can be adjusted optionally by the working of the oil hydraulic cylinders for wheels 10, 10, 10, 10. Additionally, as shown in FIG. 10, front-rear preventive rollers for fall off-wheels 11, 12 mounted to the bottom and a little to the front and rear part of the body 1 touches the frame 2, and thus the slant of the body is prevented, as shown in FIG. 10.

Figure 6:
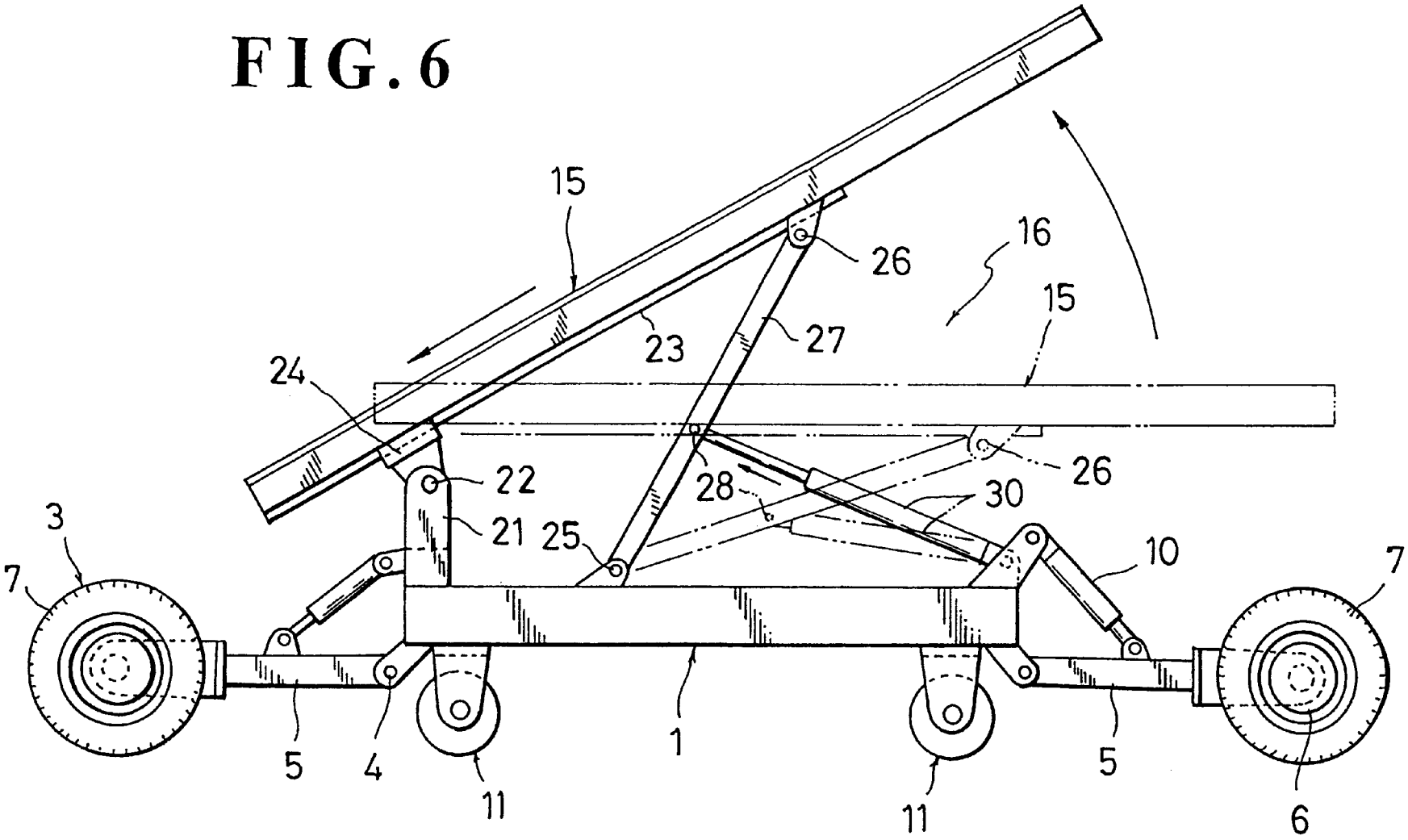
FIG. 6 is an explanatory view of movement condition for a work stand showing a first embodiment of the present invention.
Figure 7:
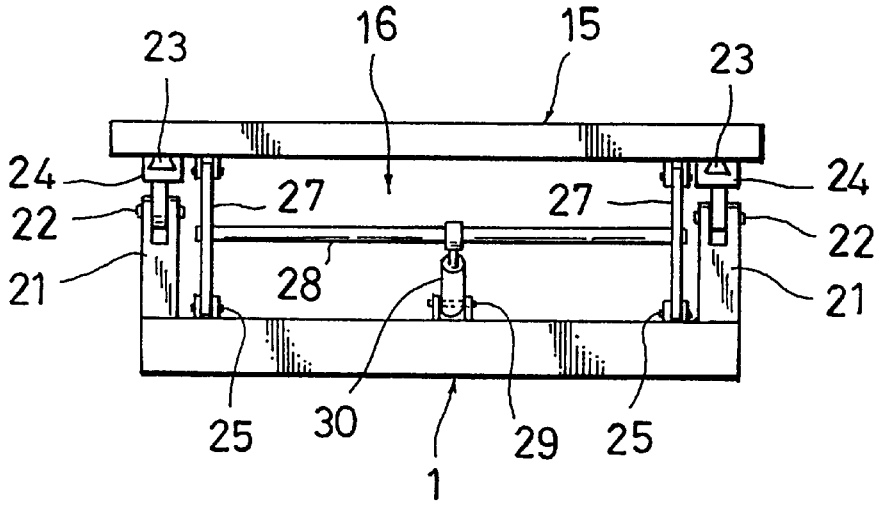
FIG. 7 is an explanatory view of a supporting device for a work stand showing a first embodiment of the present invention.

When the body 1 travels on the frame 2 of the slope, the engine 37 can be prevented from burning out as shown in FIG. 6, because the oil hydraulic cylinder for the pivoting of the work stand 30 on the work stand support device 16 is operated, and the work stand 15 is positioned nearly horizontally.

Figure 11:
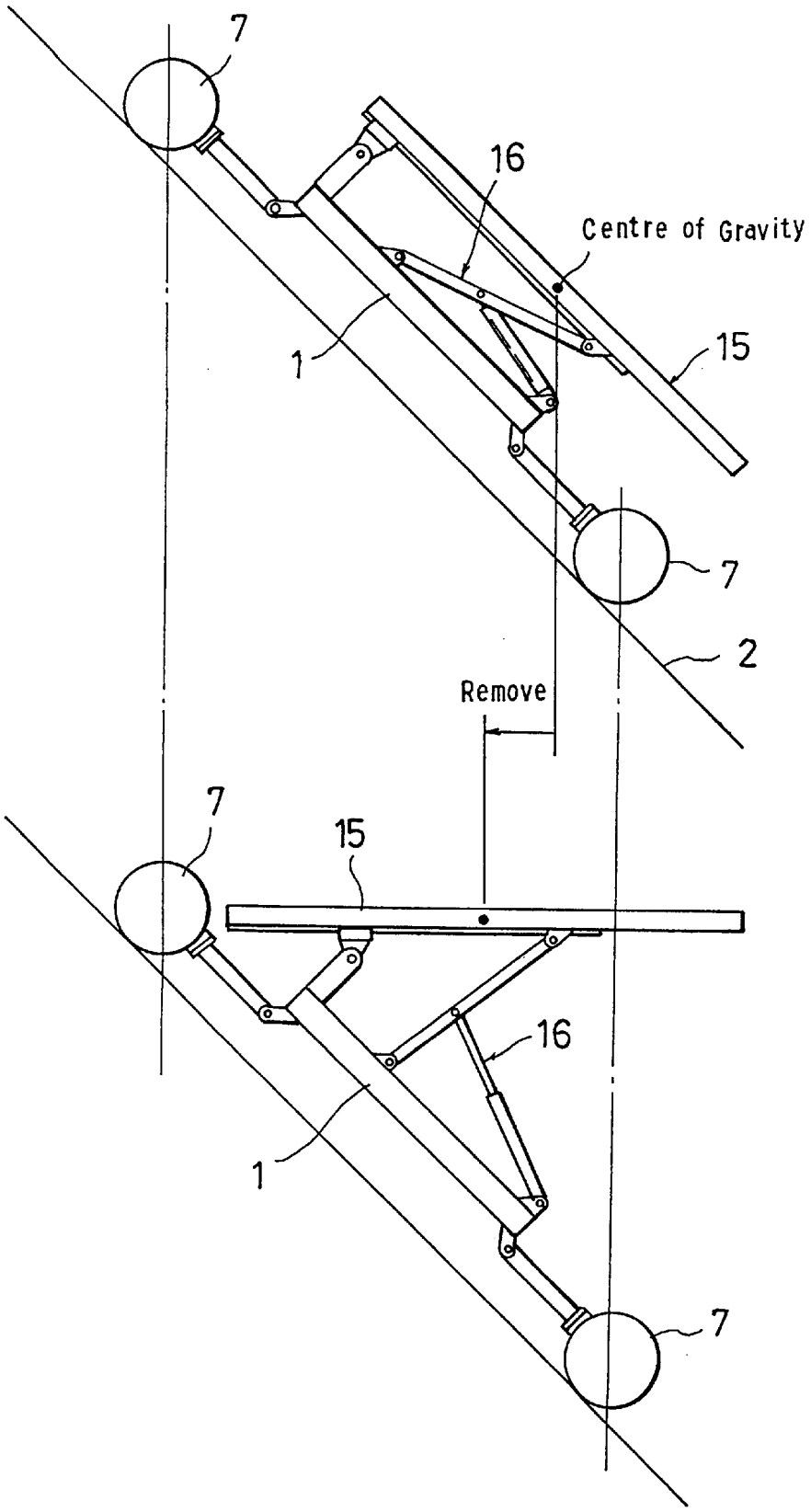
FIG. 11 is an explanatory view of movement of the center of gravity by moving of work stand showing a first embodiment of the present invention.
Figure 12:
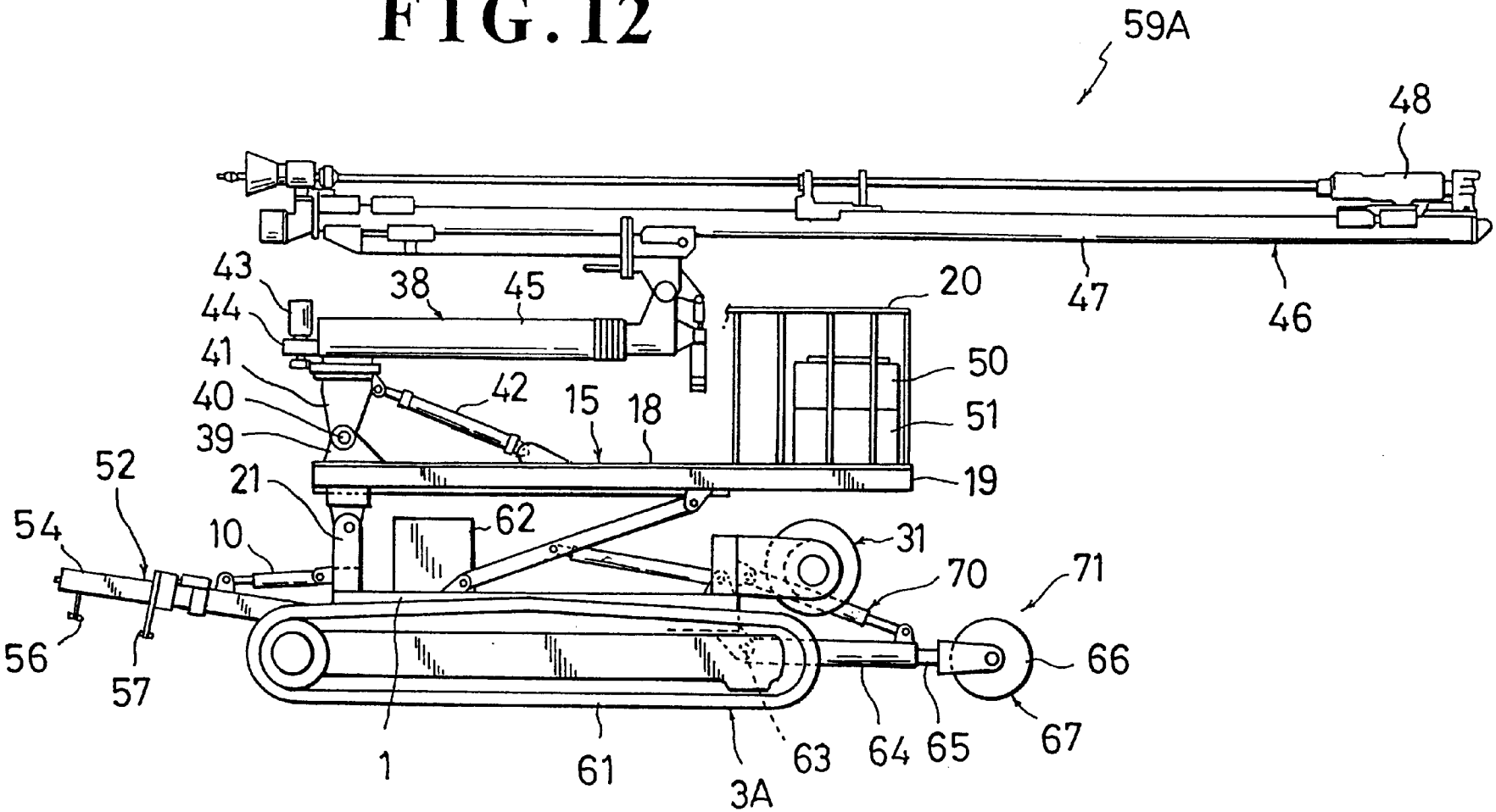
FIG. 12 is a side view showing a second embodiment of the present invention.
Figure 13:
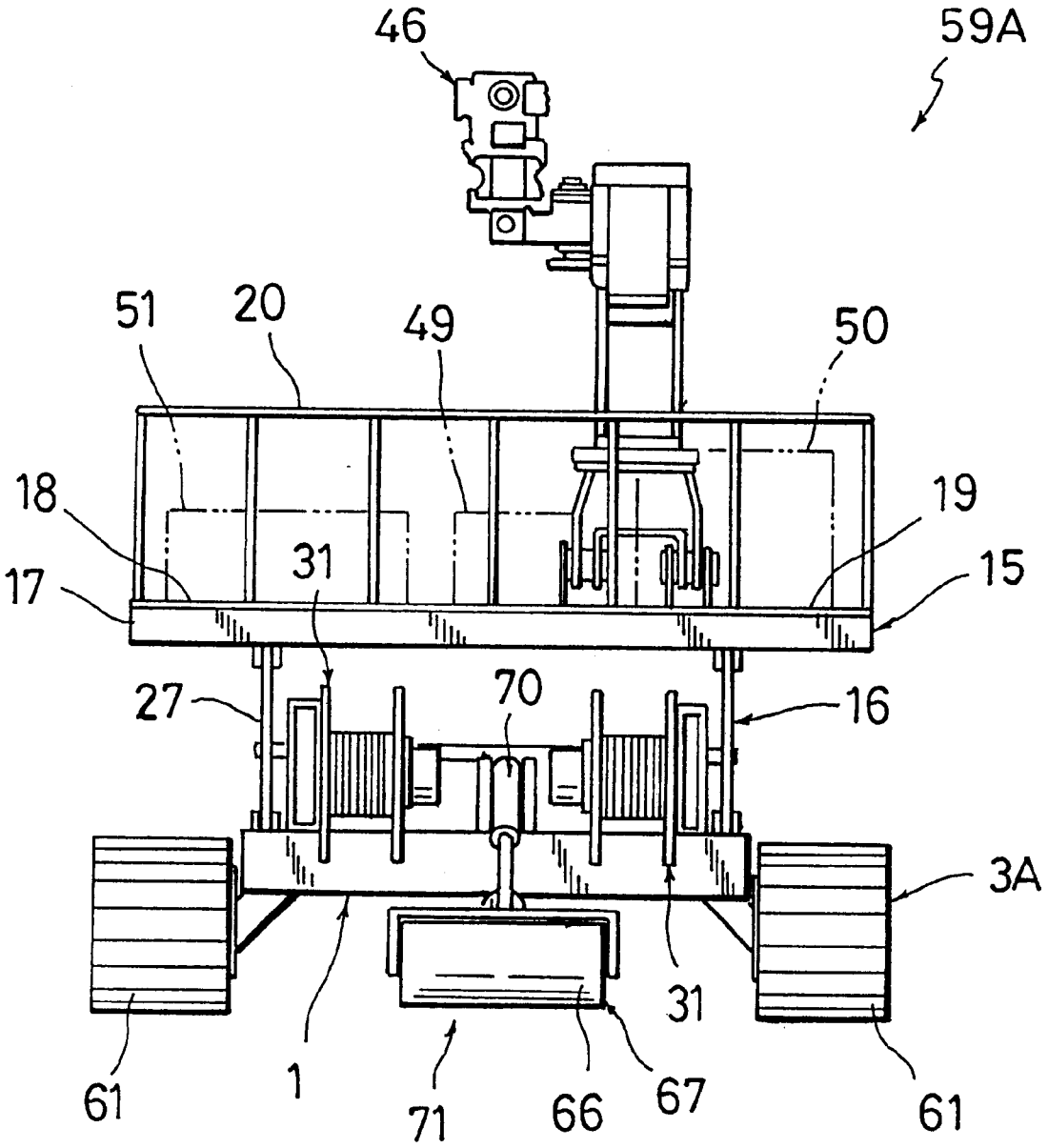
FIG. 13 is a back view showing a second embodiment of the present invention.
Figure 14:
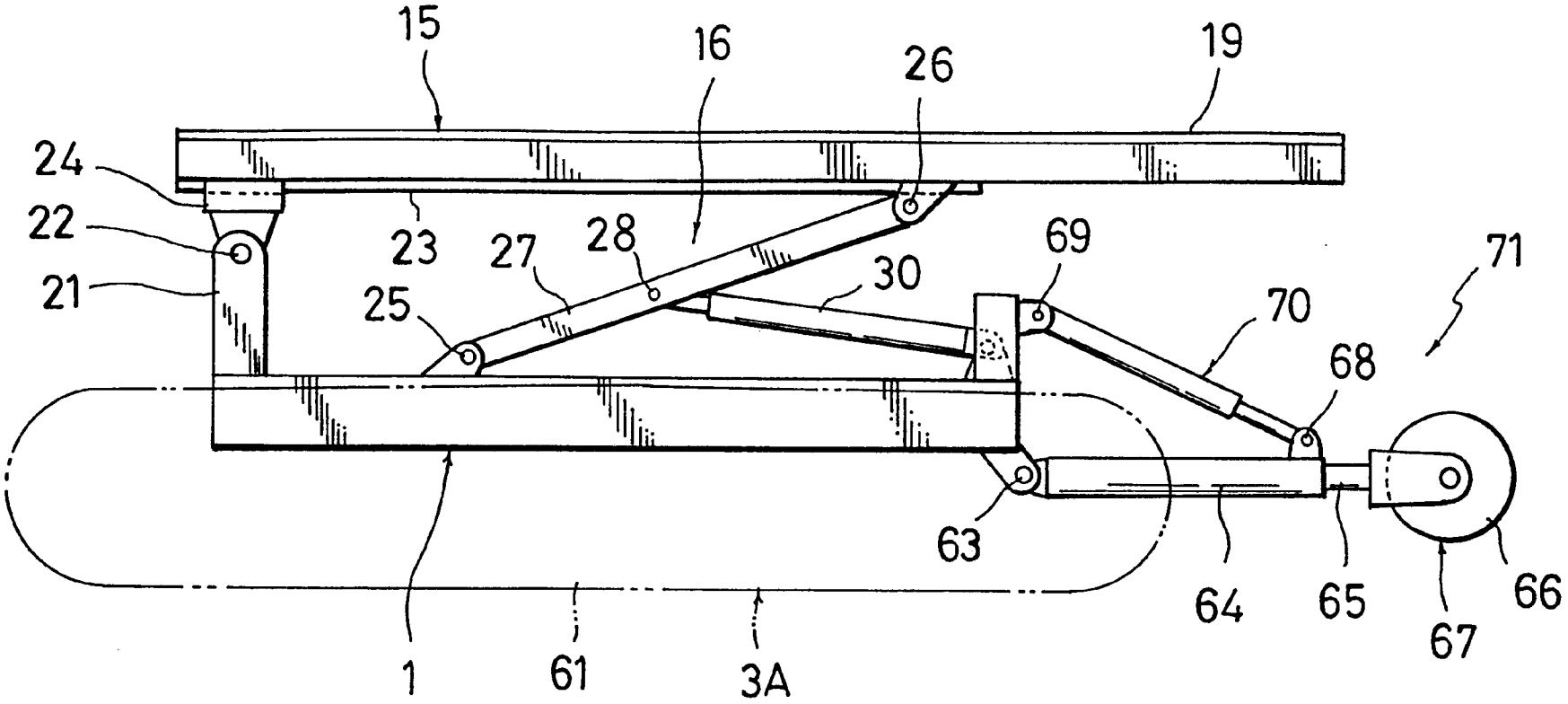
FIG. 14 is a mainly expanded side view showing a second embodiment of the present invention.
Figure 15:
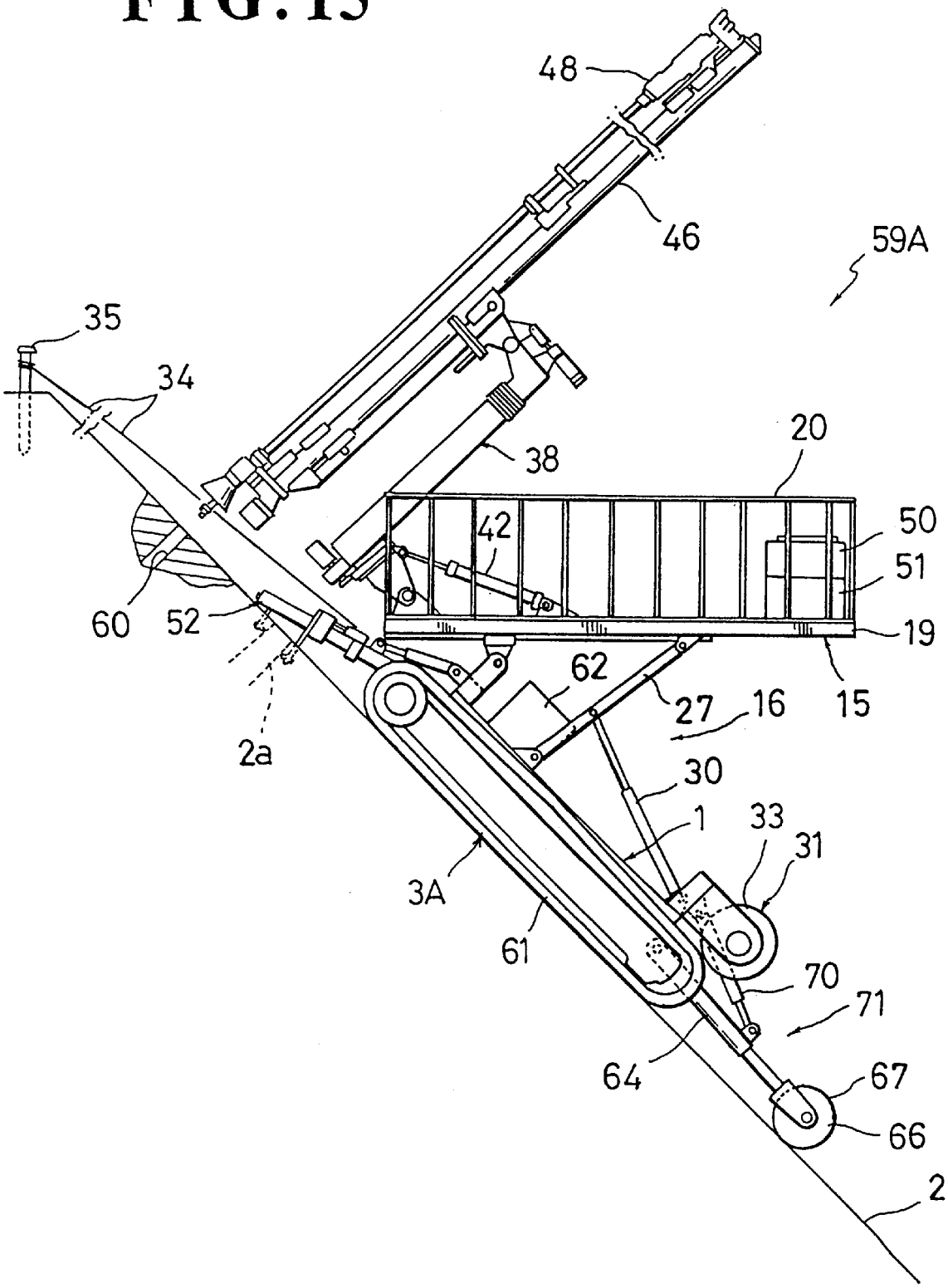
FIG. 15 is an explanatory view of a condition in use showing a second embodiment of the present invention.

Then, the work stand 15 slidably moves forward of the body 1, and thus its center of gravity also moves forward, as shown in FIG. 11.

As noted above, on the frame 2 of a steep or gentle slope, all wheels with the slope working machinery bear nearly equal weight so that the slope working machinery 59 can be made to travel stably and with efficiency. Also, the work stand 15 moves closely to the slope, slidably moving in a direction of the slope, so that the slope working from the work stand 15 can be conducted with great ease.

Figure 8:
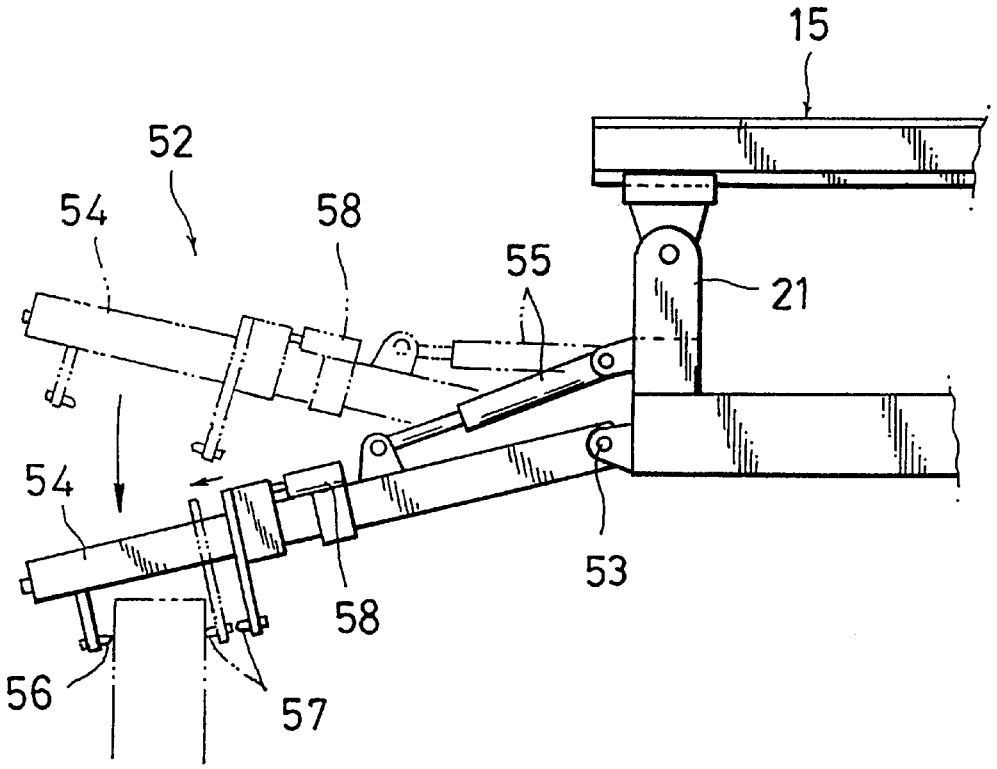
FIG. 8 is an explanatory view of locking device for a body showing a first embodiment of the present invention.

When the body 1 has travelled to the position where the working is conducted, as shown in FIG. 8, the oil hydraulic cylinders for the fixed arms 55, 55 and for the movable lock projections 58, 58 are operated, and the body 1 is fixed by the pair of the body lock devices 52, 52 to horizontal bar 2*a* of the frame 2.

In this condition, the slope working machinery is properly positioned to form a hole 60 at a cross part by operating the hole making device 46, as shown in FIG. 9.

Further embodiments of the present invention will now be described referring to FIGS. 12 to 53. Like components are represented by like numbers as denoted in the first embodiment and thus, explanation will not be repeated for ease of description.

A second embodiment of the present invention shown in FIGS. 12 to 16 is distinguished from the first embodiment by the fact that the running device 3 is replaced with another like device 3A which is instead comprised of caterpillars 61, 61 and an oil hydraulic driving gear device 62, and also a fall down-prevention device which is comprised of a fall down-prevention member 67 and an oil hydraulic cylinder 70 as a pushing pressure device is provided. The caterpillars 61, 61 are mounted to both sides of the body 1, and the oil hydraulic driving gear device 62 can be operated to drive the caterpillars 61, 61, used to the oil hydraulic backhoe. Additionally, the fall down-prevention device 67 is comprised an oil hydraulic cylinder body 64 as a pivot arm, an operation bar 65 as an extend-contract arm and a roller 66. The oil hydraulic cylinder body 64 juts out the play end part pivotably mounted by a pivot pin 63 to the rear part of the body 1, and the operation bar 65 extends and contracts from the oil hydraulic cylinder body 64, also the roller 66 is pivotably mounted to the end of the operation bar 65. Moreover, the oil hydraulic cylinder 70 always presses the play end part of the fall down-prevention member 67 against the ground with fixed pushing pressure, one end thereof is pivotably mounted by a pivot pin 68 to the part a little to the end part of the oil hydraulic cylinder body 64, another end thereof is pivotably mounted by a pivot pin 69 to the part of the body 1 capable of pivoting the oil hydraulic cylinder body 64. A slope working machinery 59A with the running device 3A and the fall down-prevention device 71 according to the second embodiment will provide the same effects as the first embodiment while the fall down-prevention device 71 can be prevented to fall down on the slope with efficiency by sustaining a weight added in the direction of falling down of the body 1.

Figure 16:
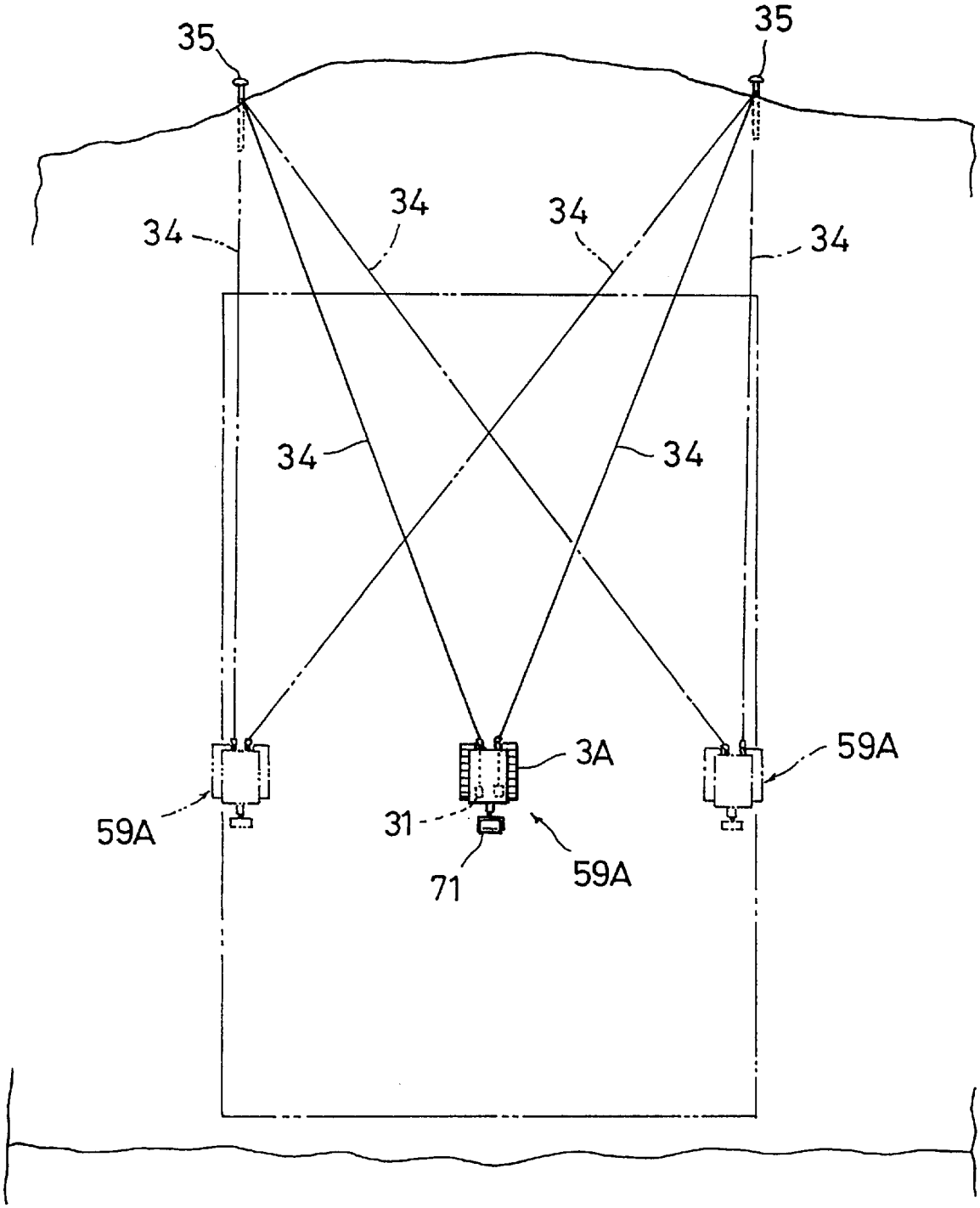
FIG. 16 is an explanatory view of a sphere for working showing a second embodiment of the present invention.
Figure 17:
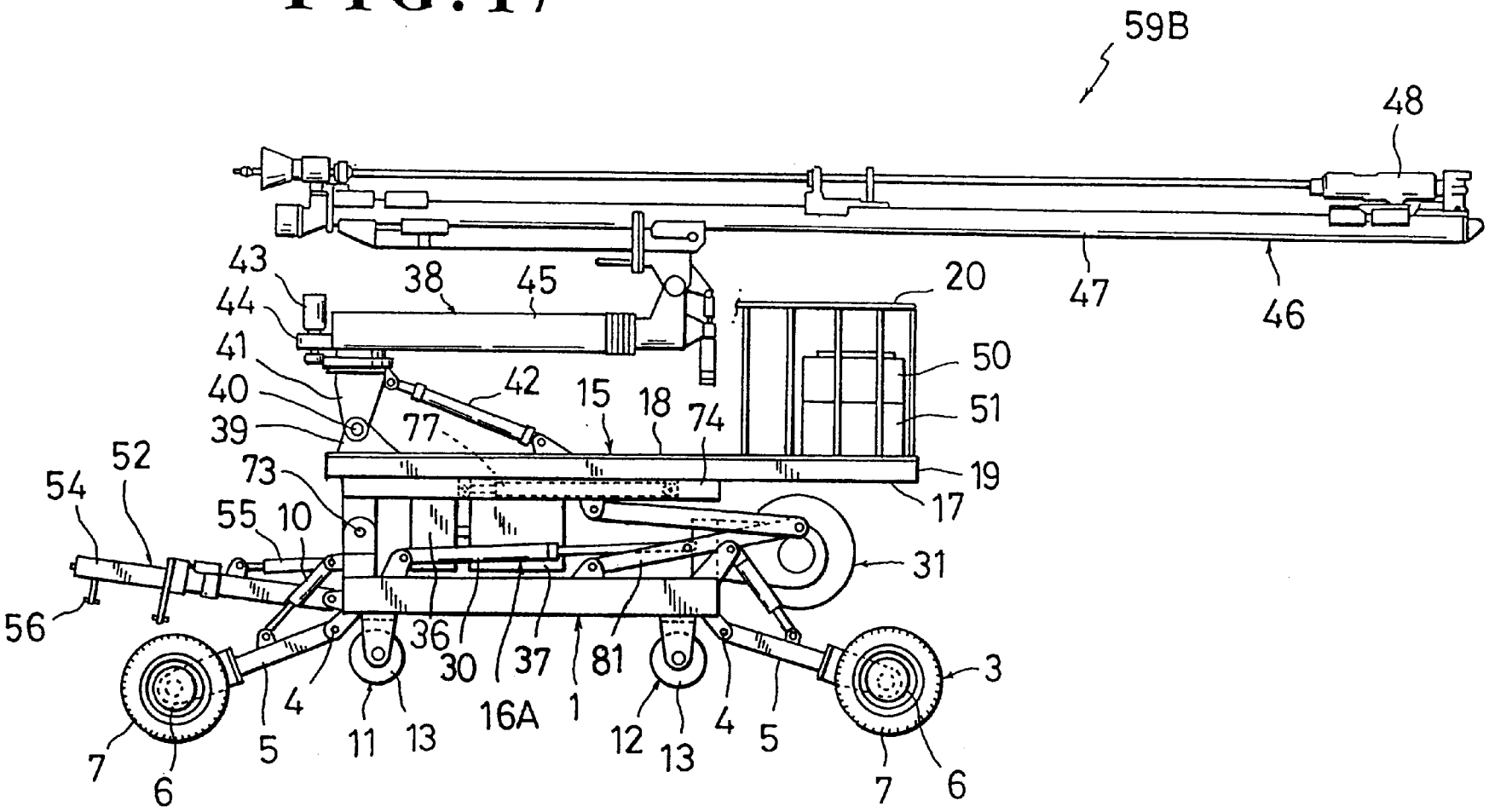
FIG. 17 is a side view showing a third embodiment of the present invention.
Figure 18:
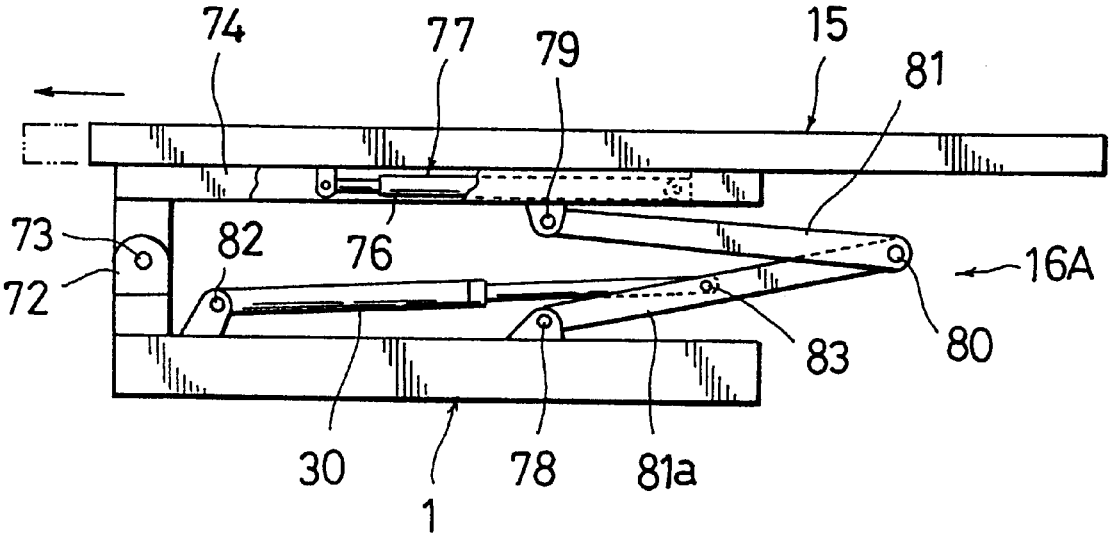
FIG. 18 is a partial cross sectional side view of a supporting device for work stand showing a third embodiment of the present invention.
Figure 19:
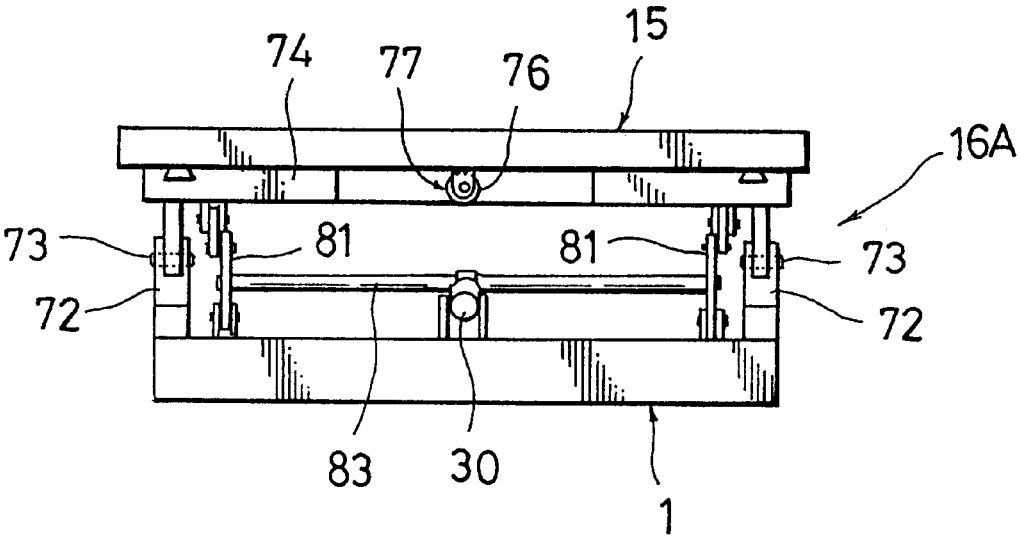
FIG. 19 is a front view of a supporting device for work stand showing a third embodiment of the present invention.
Figure 20:
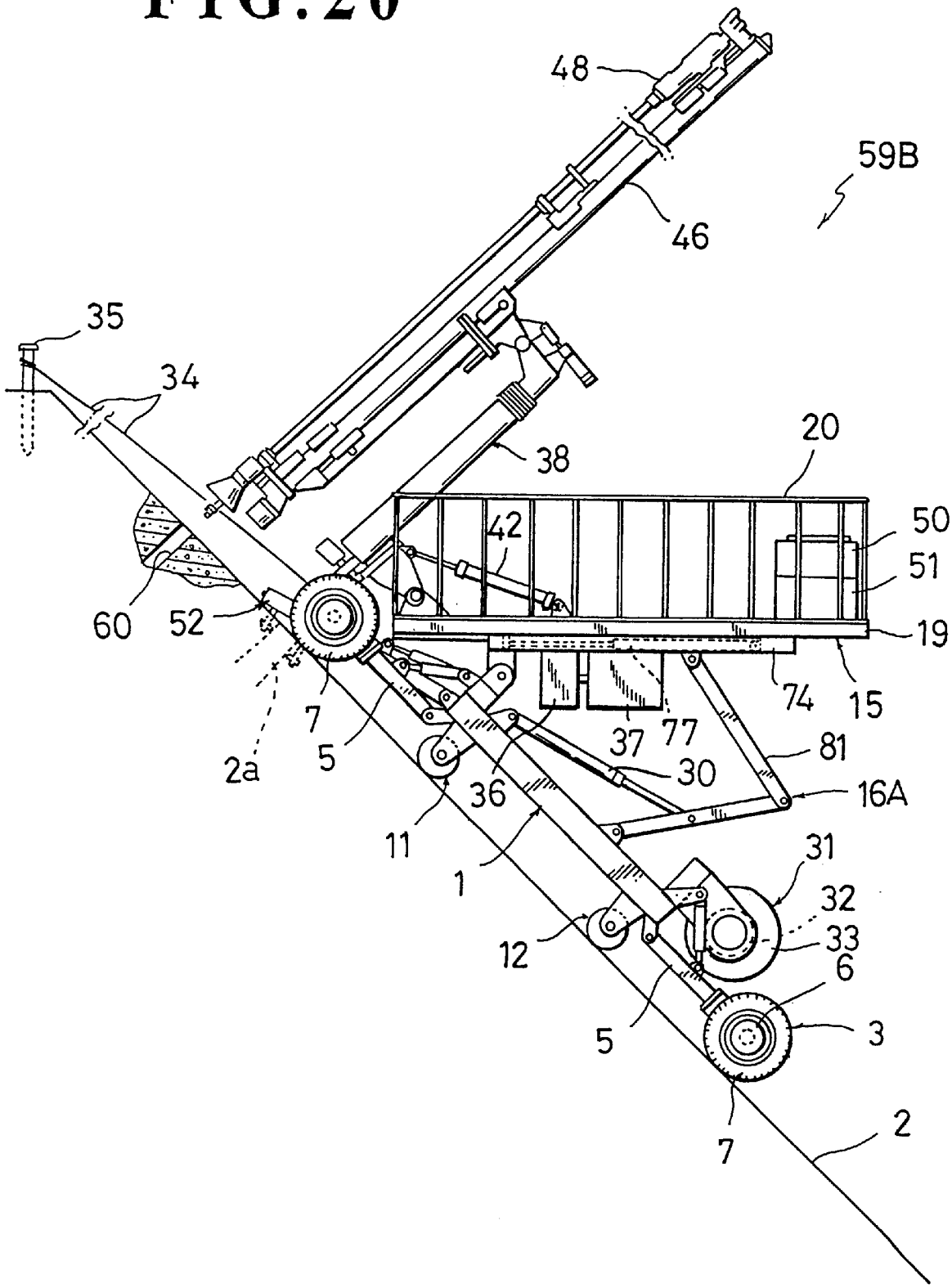
FIG. 20 is an explanatory view of a condition in use showing a third embodiment of the present invention.
Figure 21:
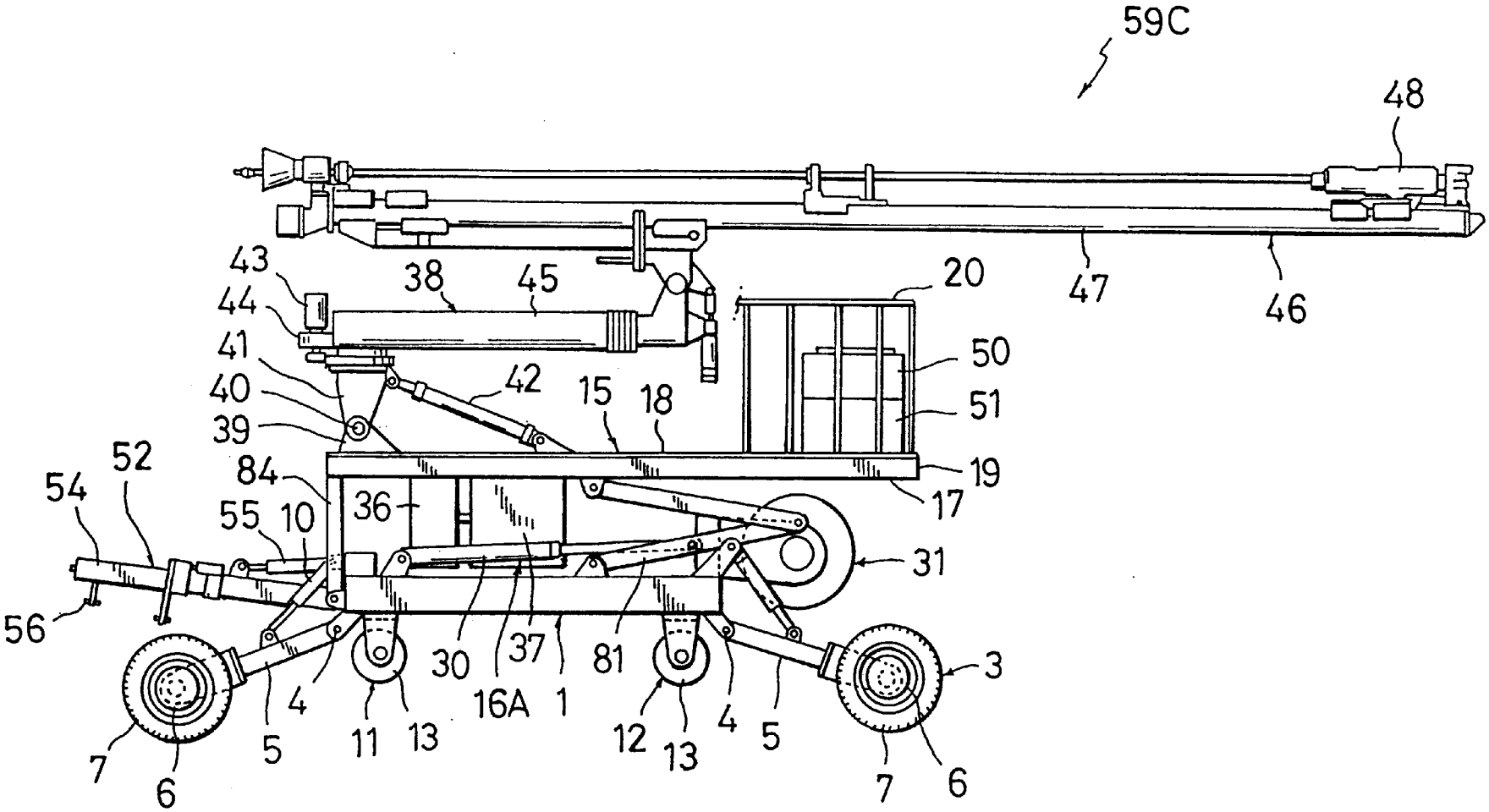
FIG. 21 is a side view showing a fourth embodiment of the present invention.
Figure 22:
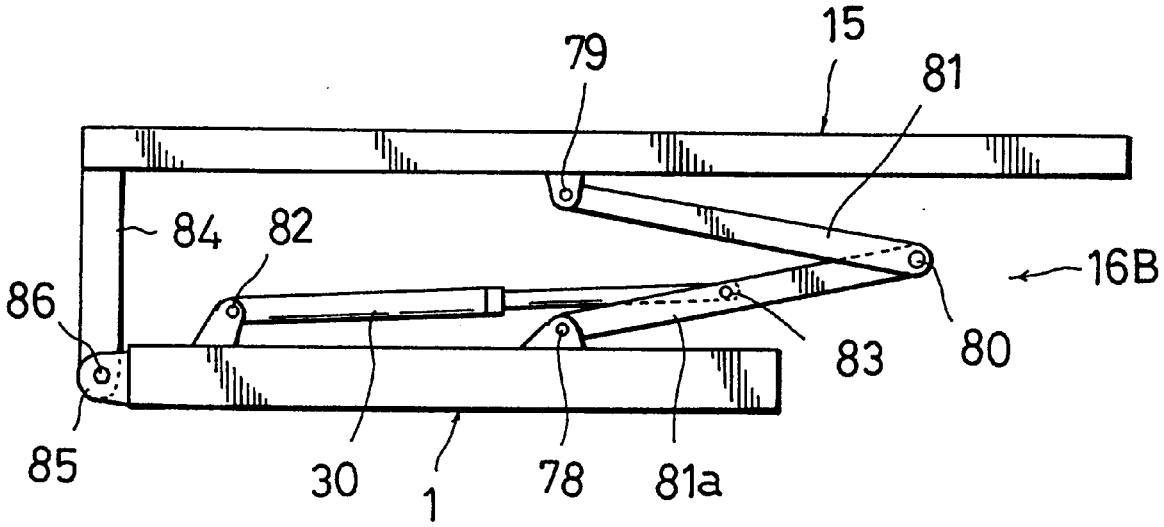
FIG. 22 is a side view of a work stand support device showing a fourth embodiment of the present invention.
Figure 23:
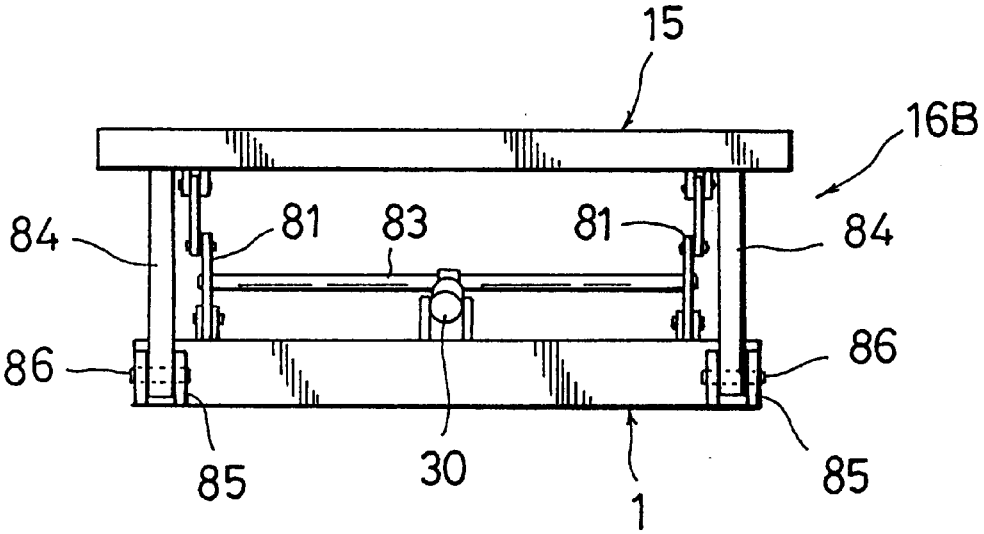
FIG. 23 is a front view of a work stand support device showing a fourth embodiment of the present invention.
Figure 24:
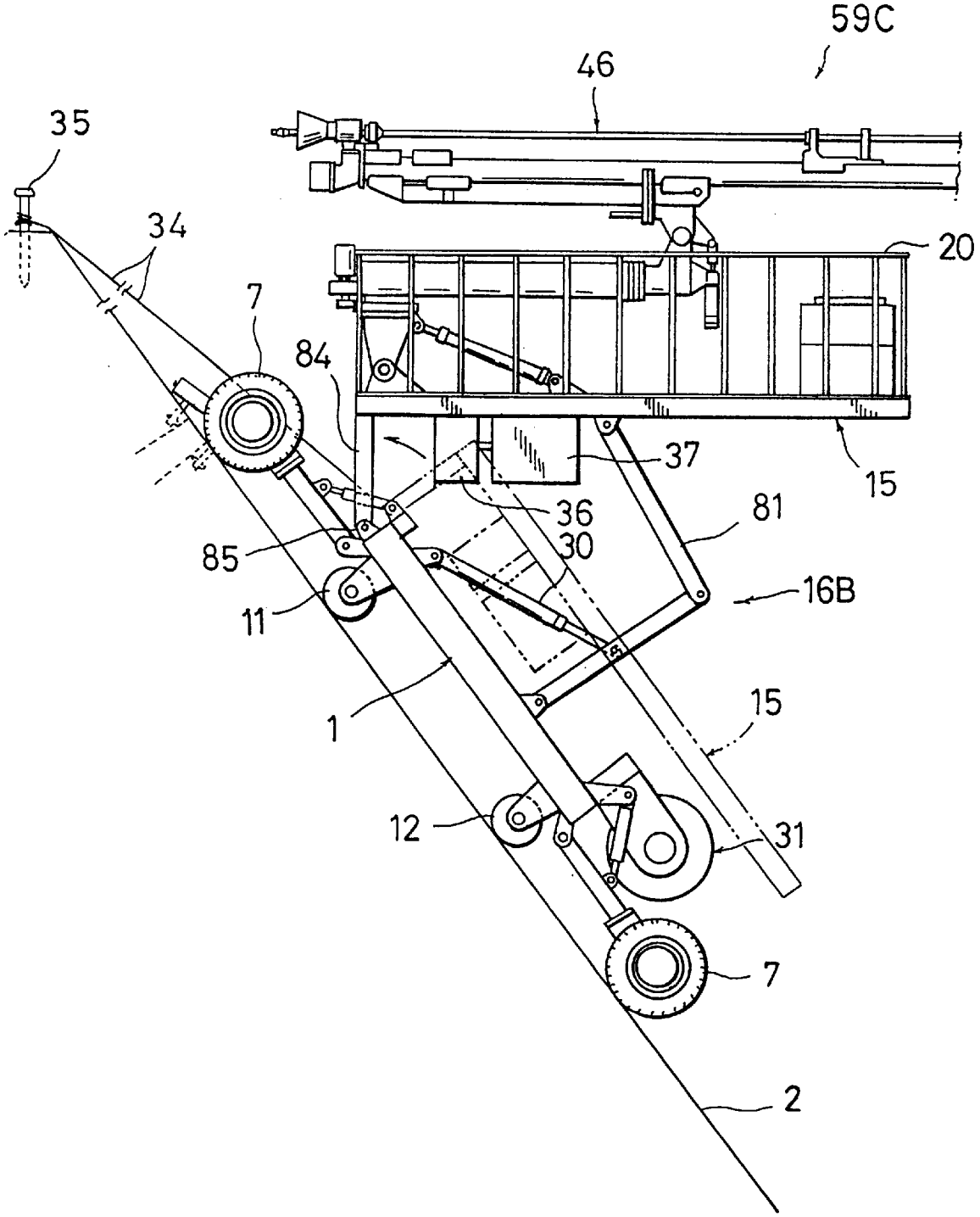
FIG. 24 is an explanatory view of a condition in use showing a fourth embodiment of the present invention.
Figure 25:
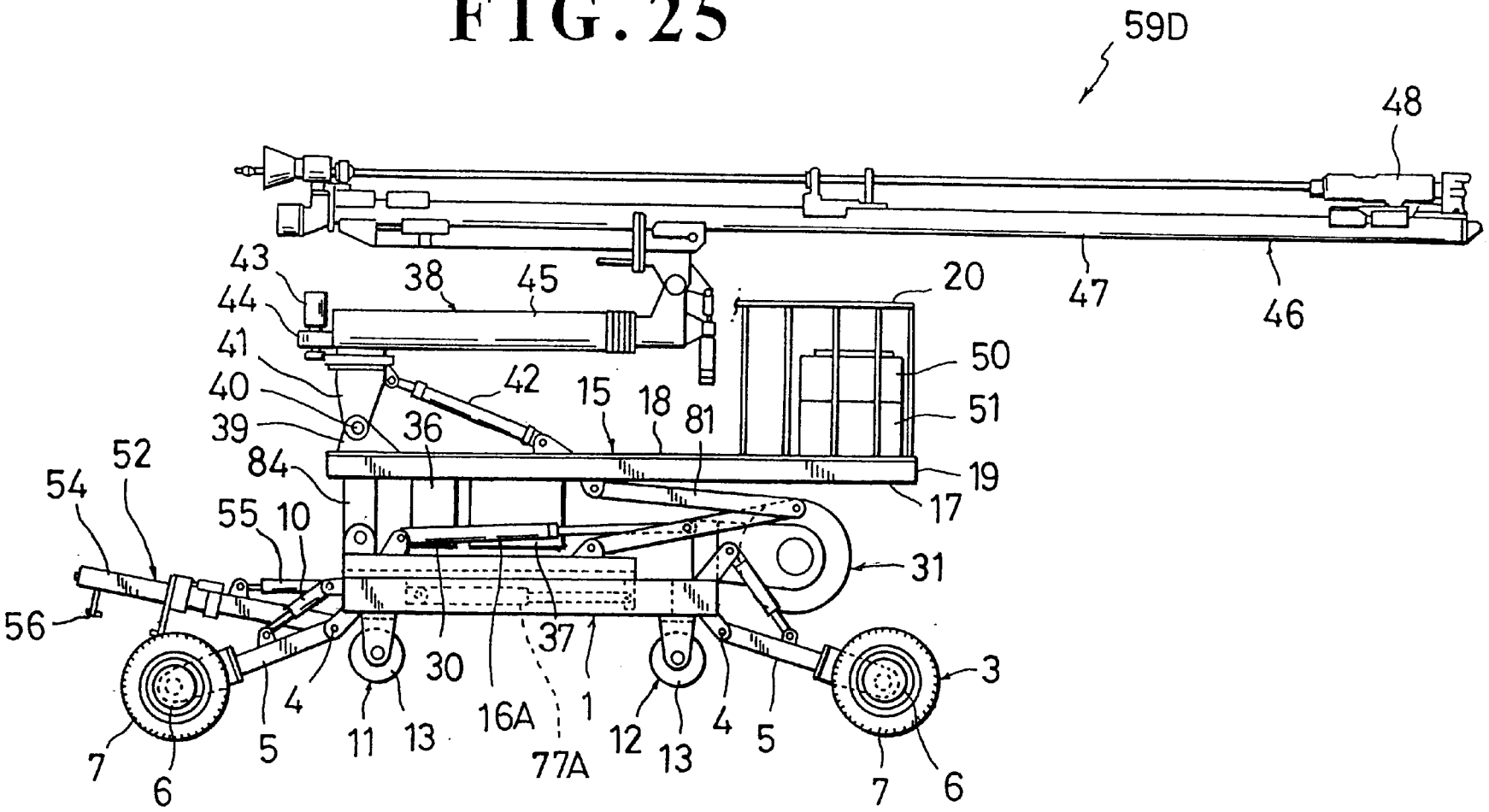
FIG. 25 is a side view showing a fifth embodiment of the present invention.
Figure 26:
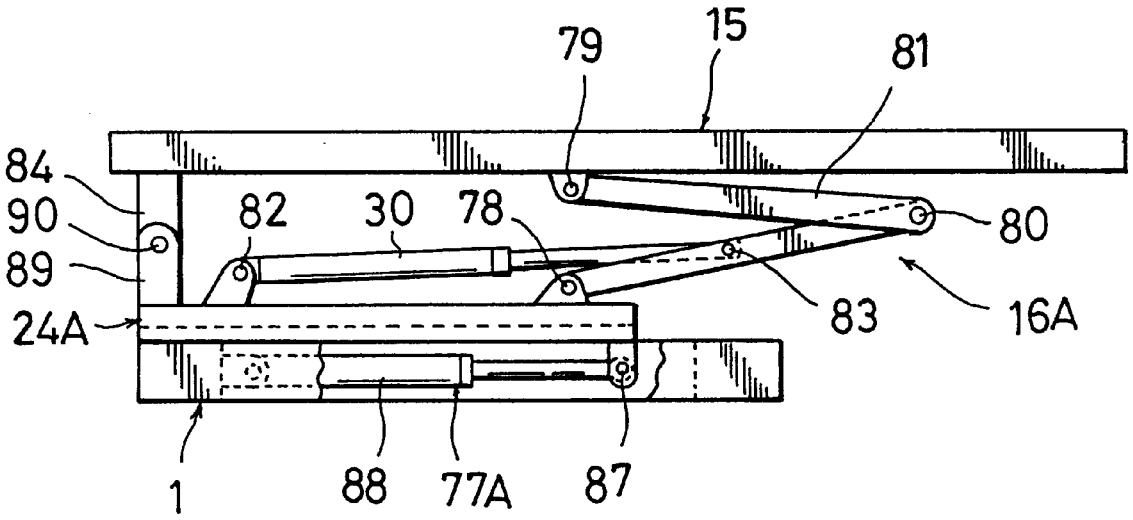
FIG. 26 is a partial cross sectional side view of a work stand support device showing a fifth embodiment of the present invention.
Figure 27:
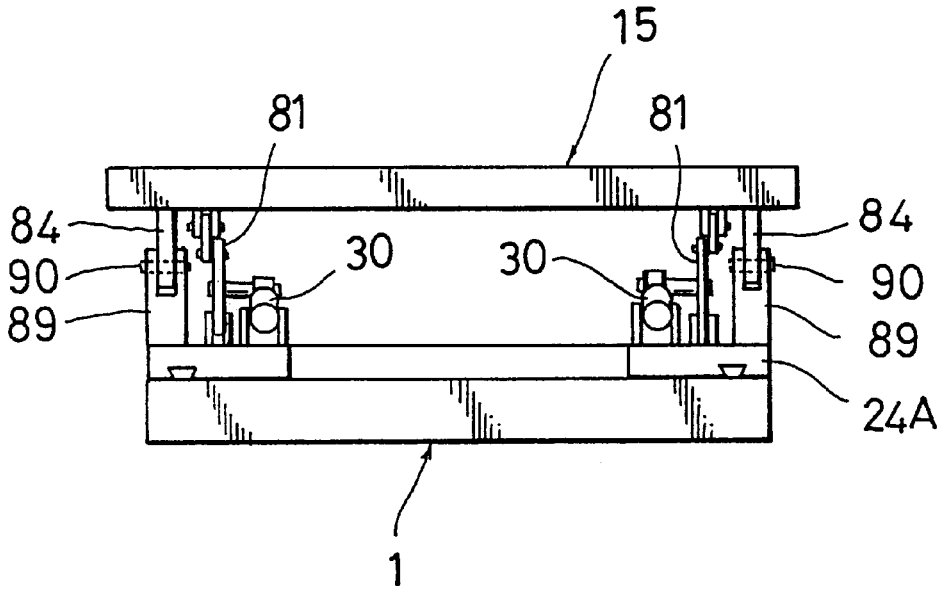
FIG. 27 is a front view of a work stand support device showing a fifth embodiment of the present invention.
Figure 28:
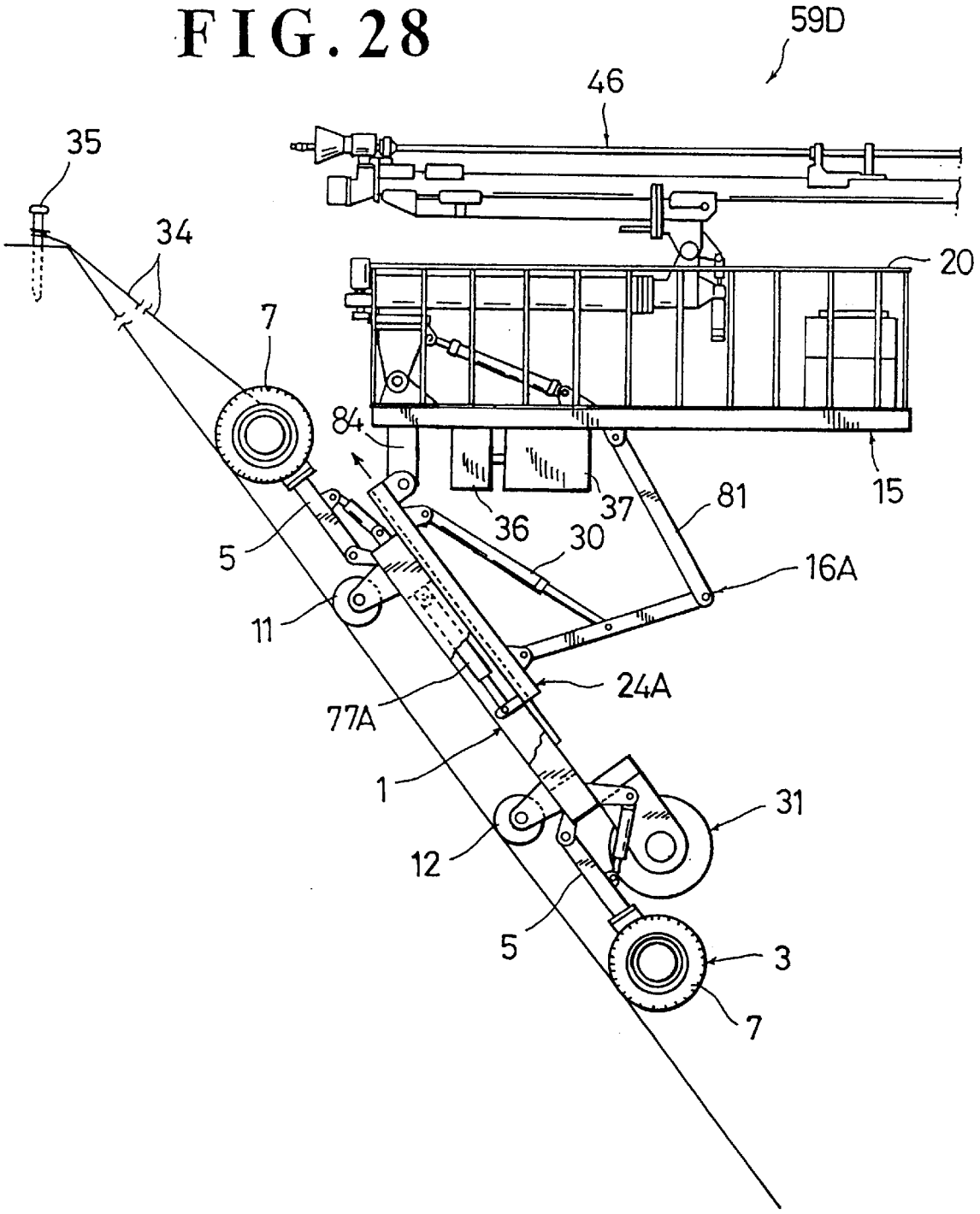
FIG. 28 is an explanatory view of a condition in use showing a fifth embodiment of the present invention.
Figure 29:
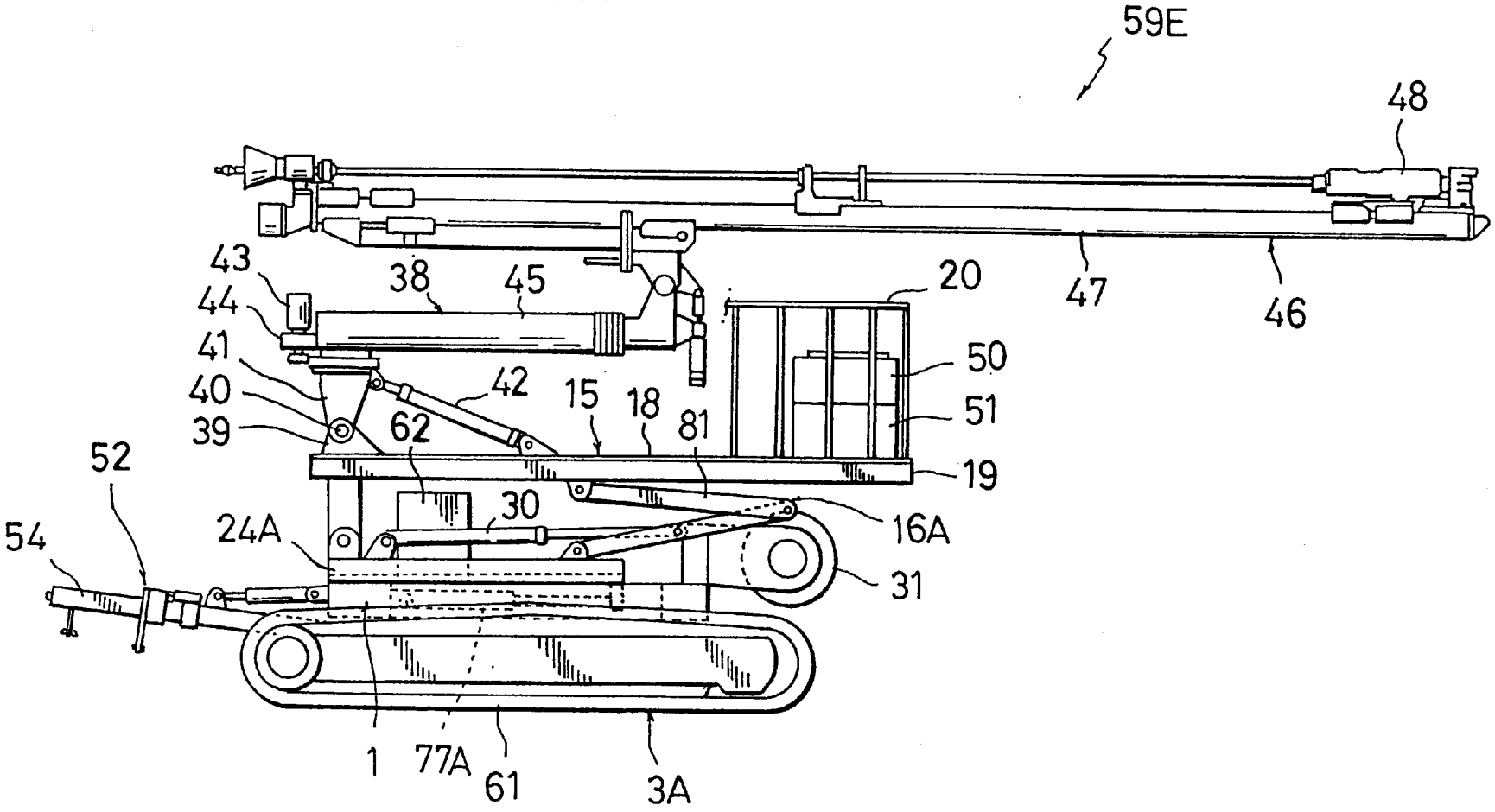
FIG. 29 is a side view showing a sixth embodiment of the present invention.
Figure 30:
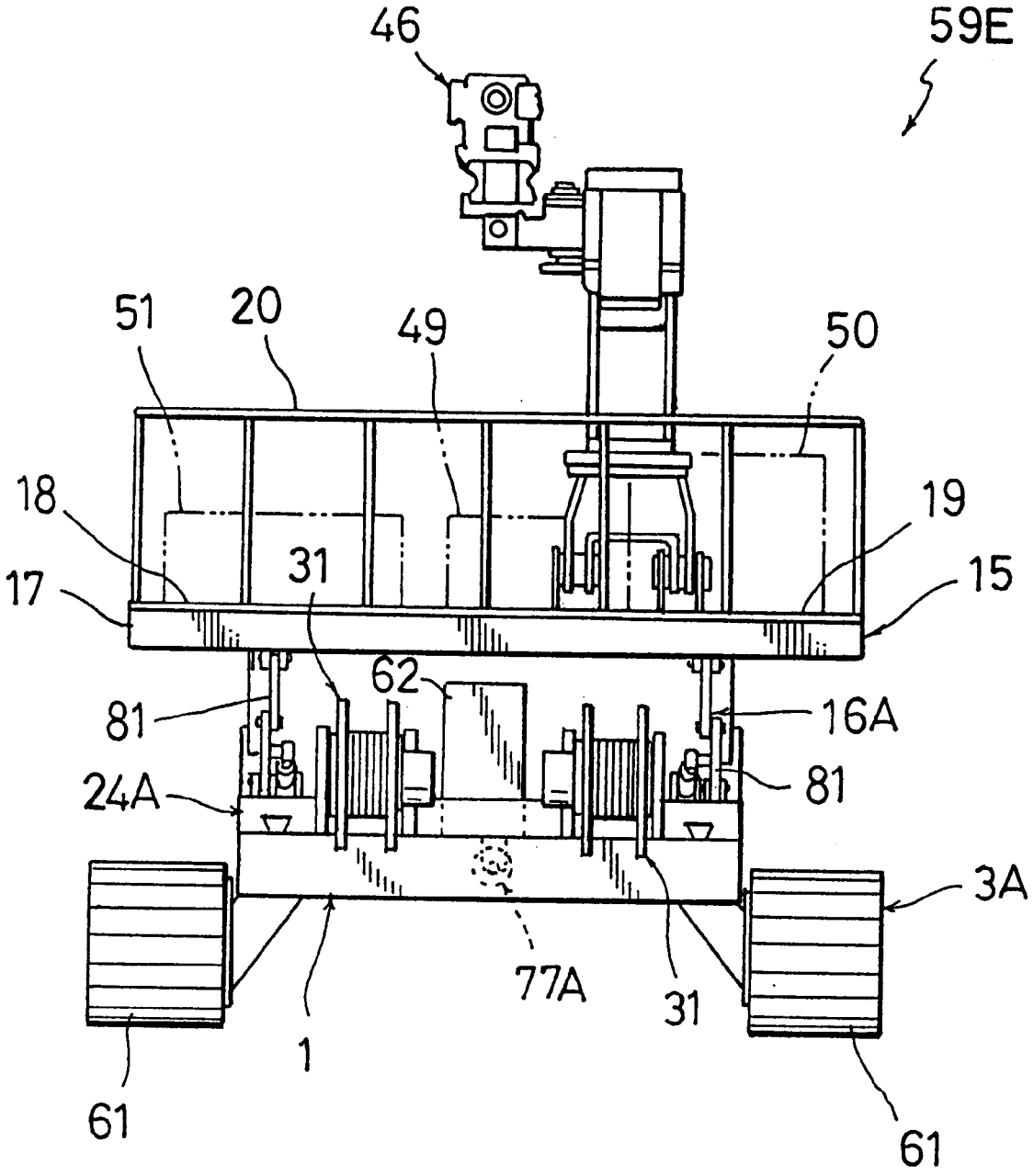
FIG. 30 is a back view showing a sixth embodiment of the present invention.
Figure 31:
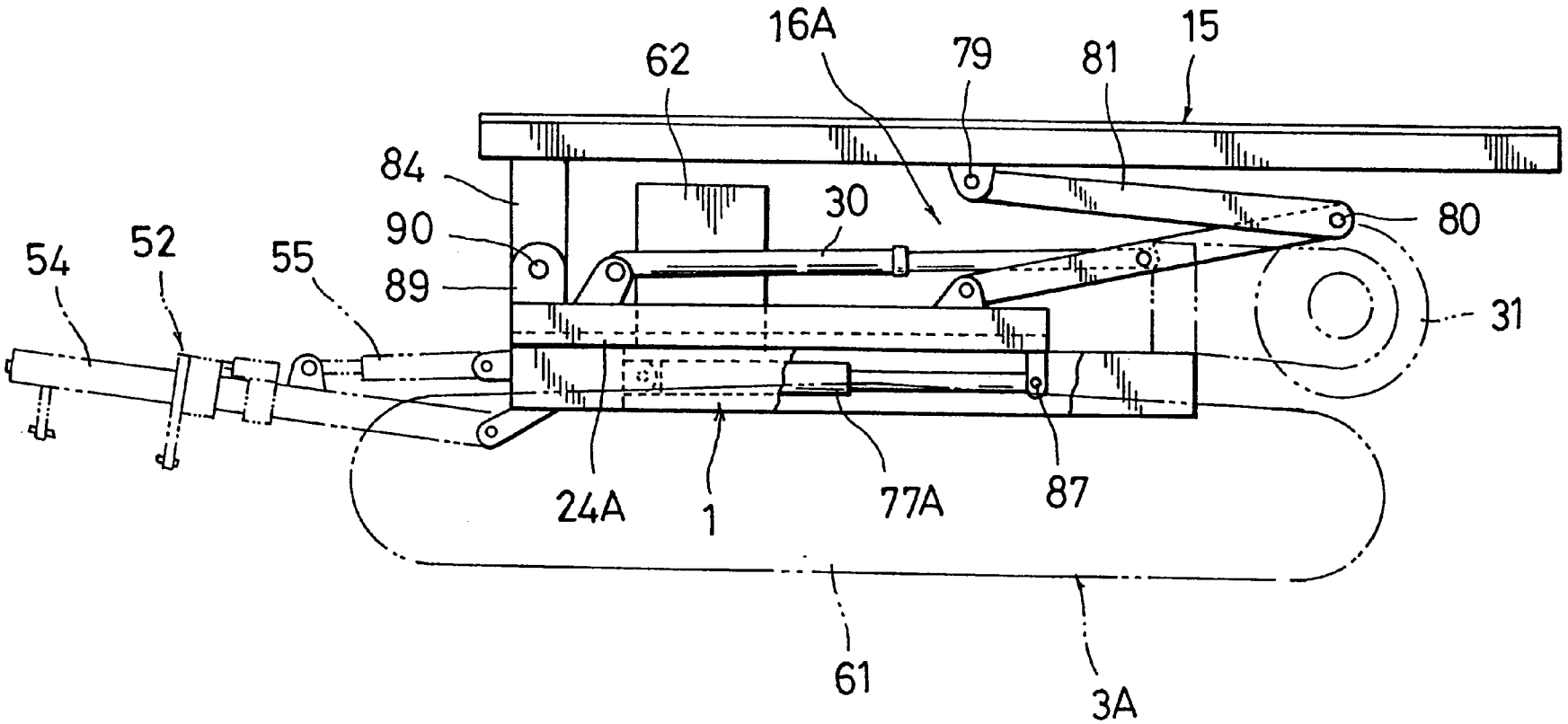
FIG. 31 is a mainly expanded side view showing a sixth embodiment of the present invention.
Figure 32:
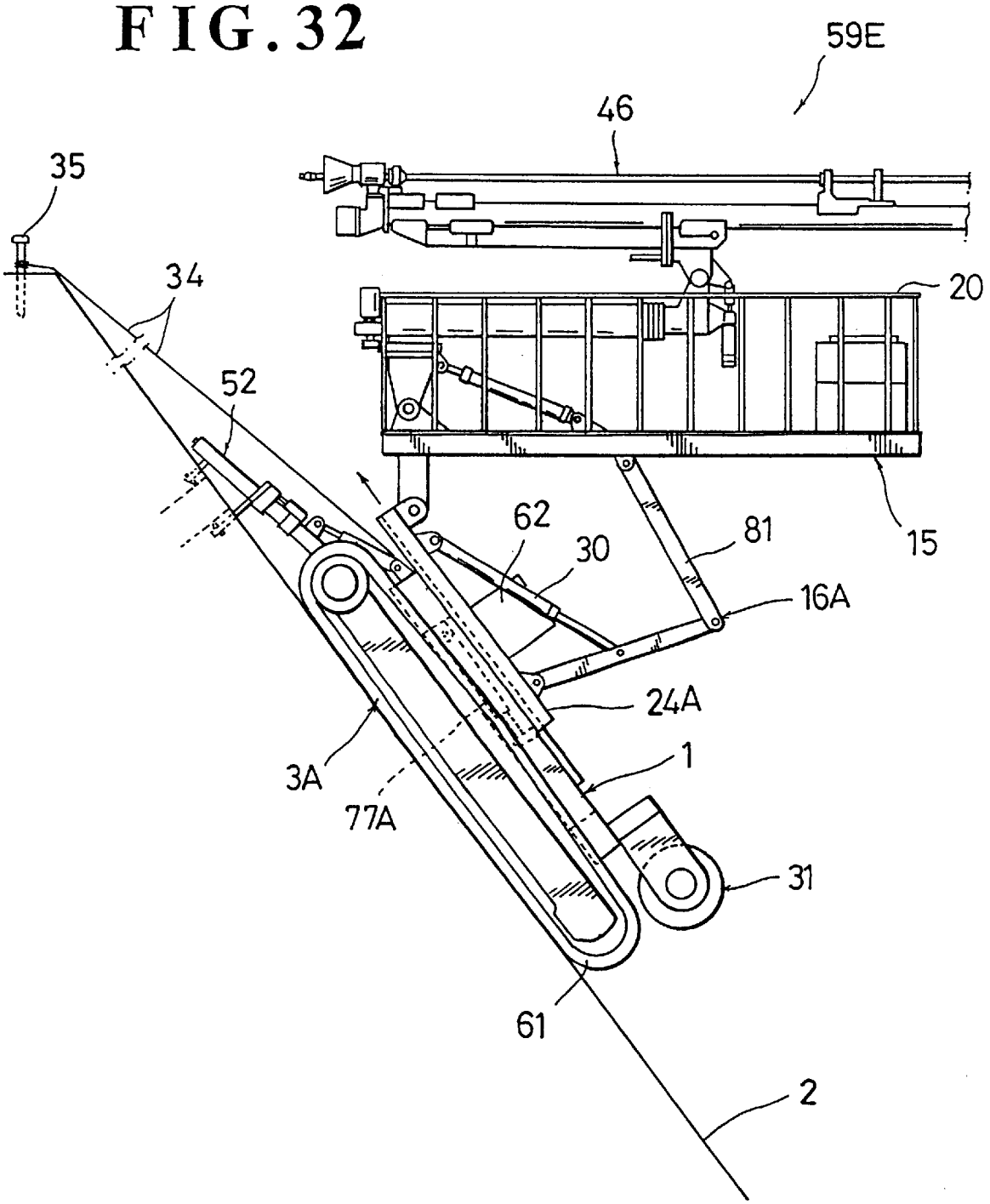
FIG. 32 is an explanatory view of a condition in use showing a sixth embodiment of the present invention.
Figure 33:
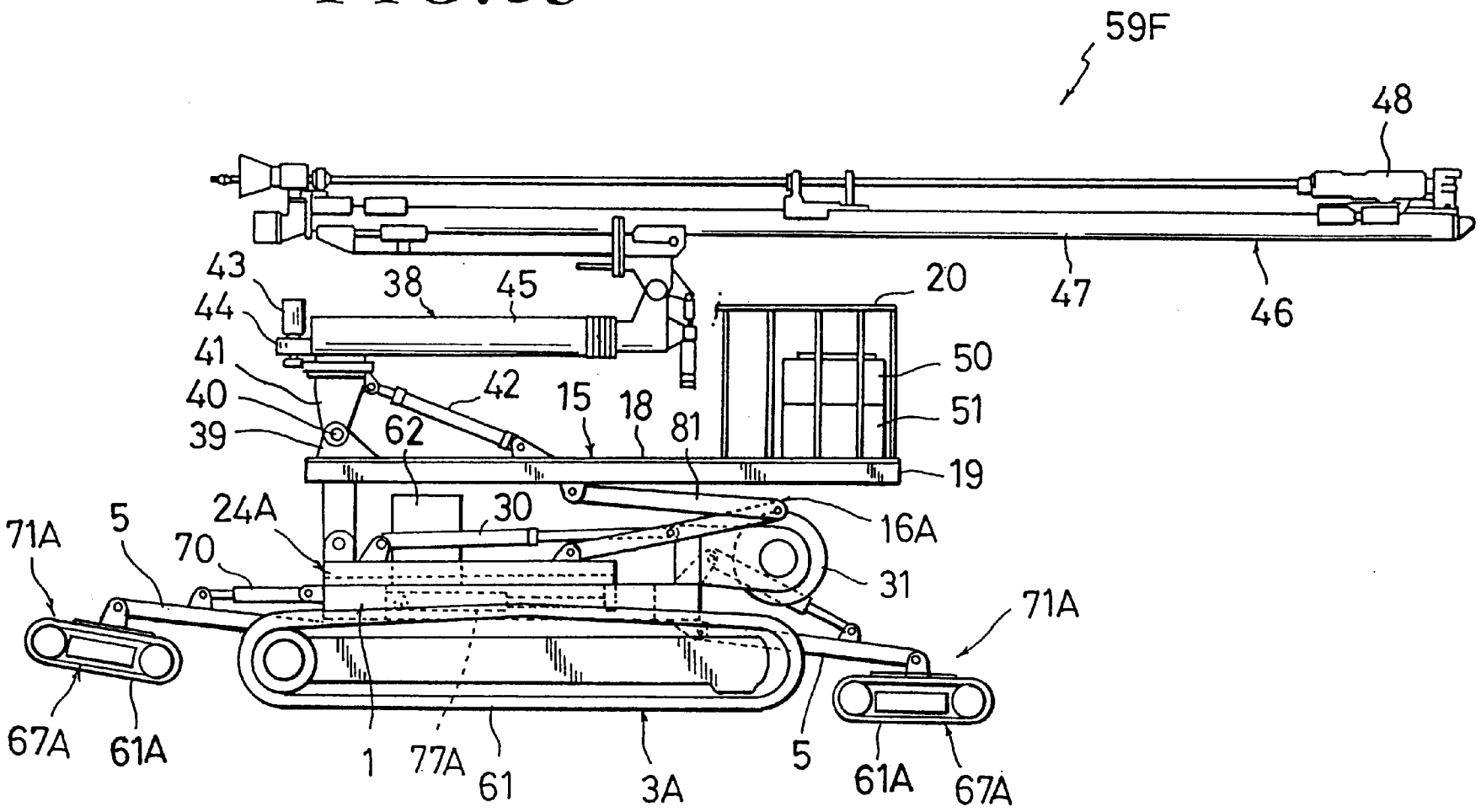
FIG. 33 is a side view showing a seventh embodiment of the present invention.
Figure 34:
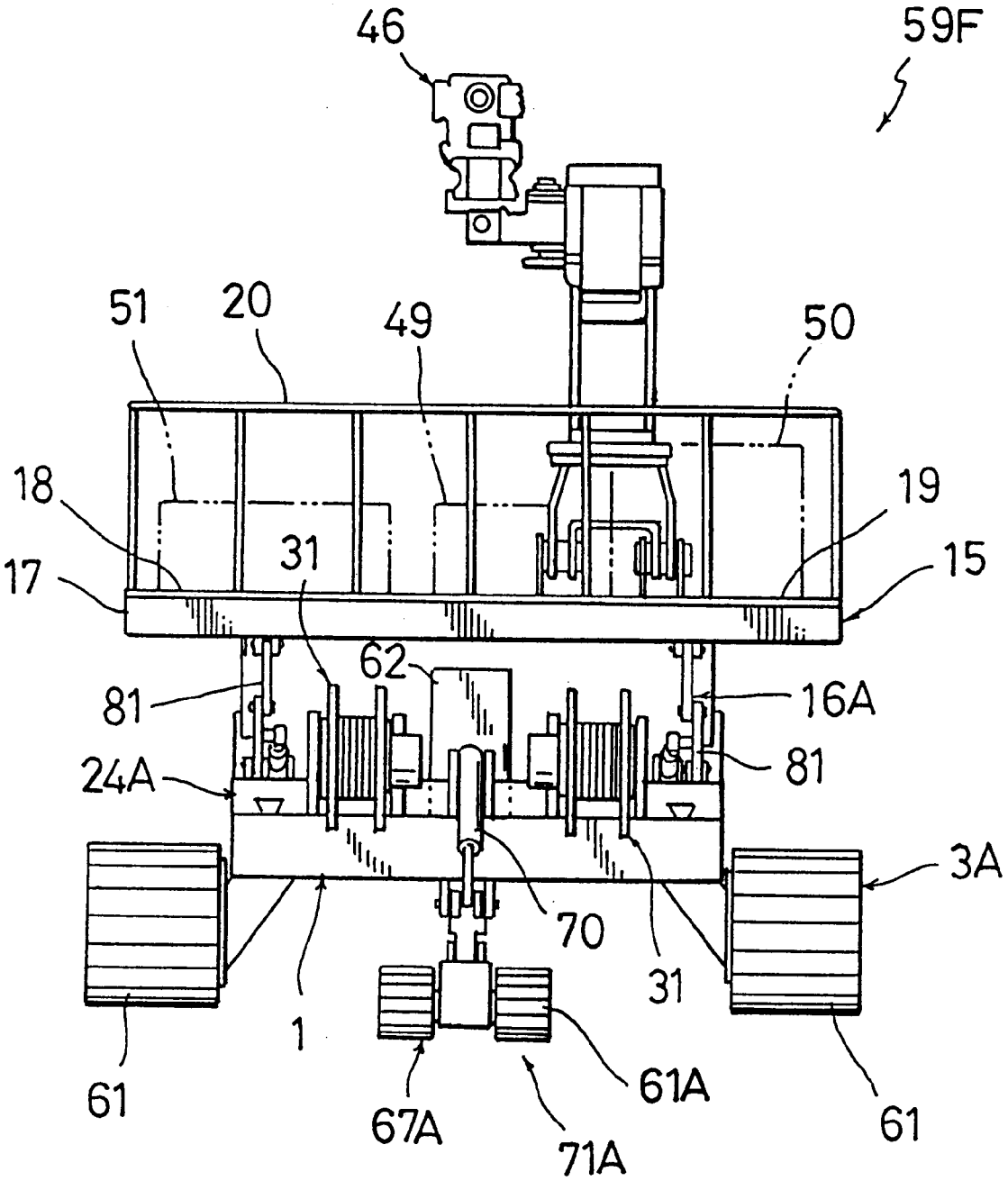
FIG. 34 is a back view showing a seventh embodiment of the present invention.
Figure 35:
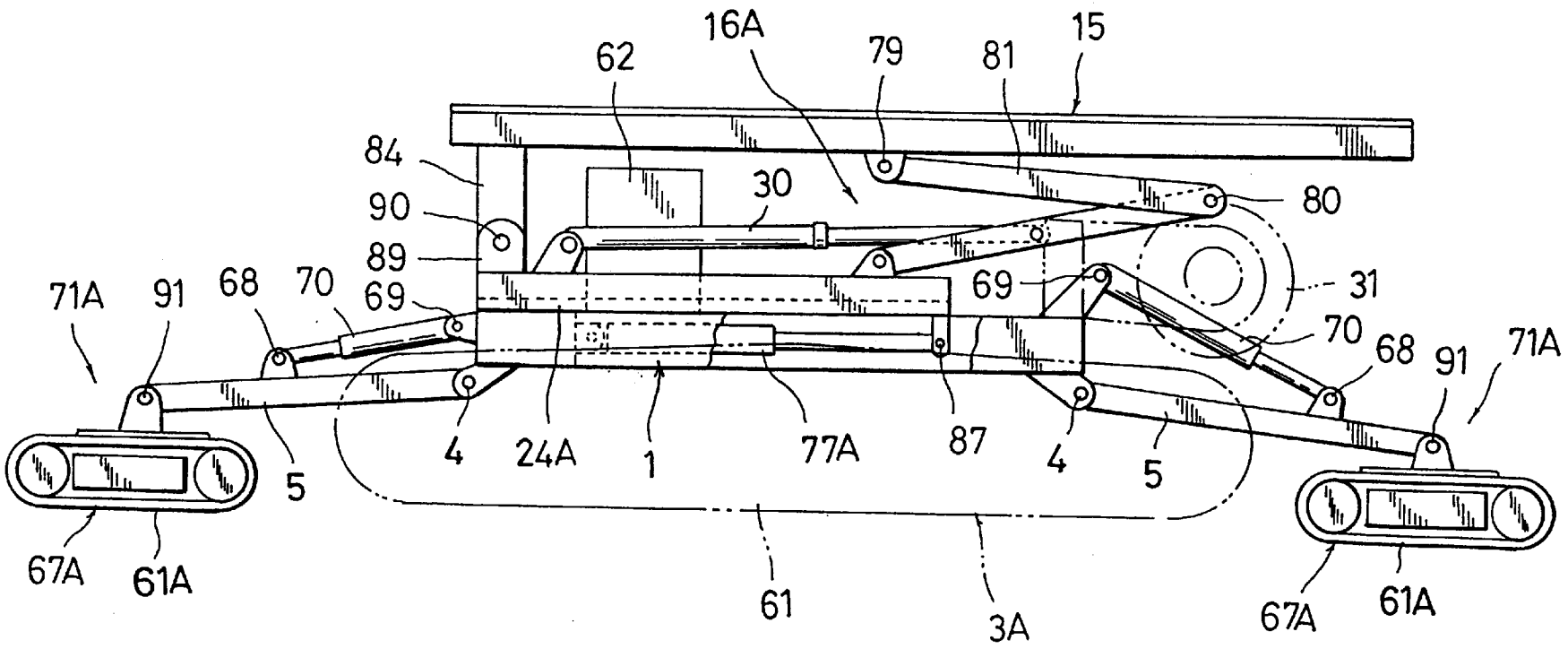
FIG. 35 is a mainly expanded side view showing a seventh embodiment of the present invention.
Figure 36:
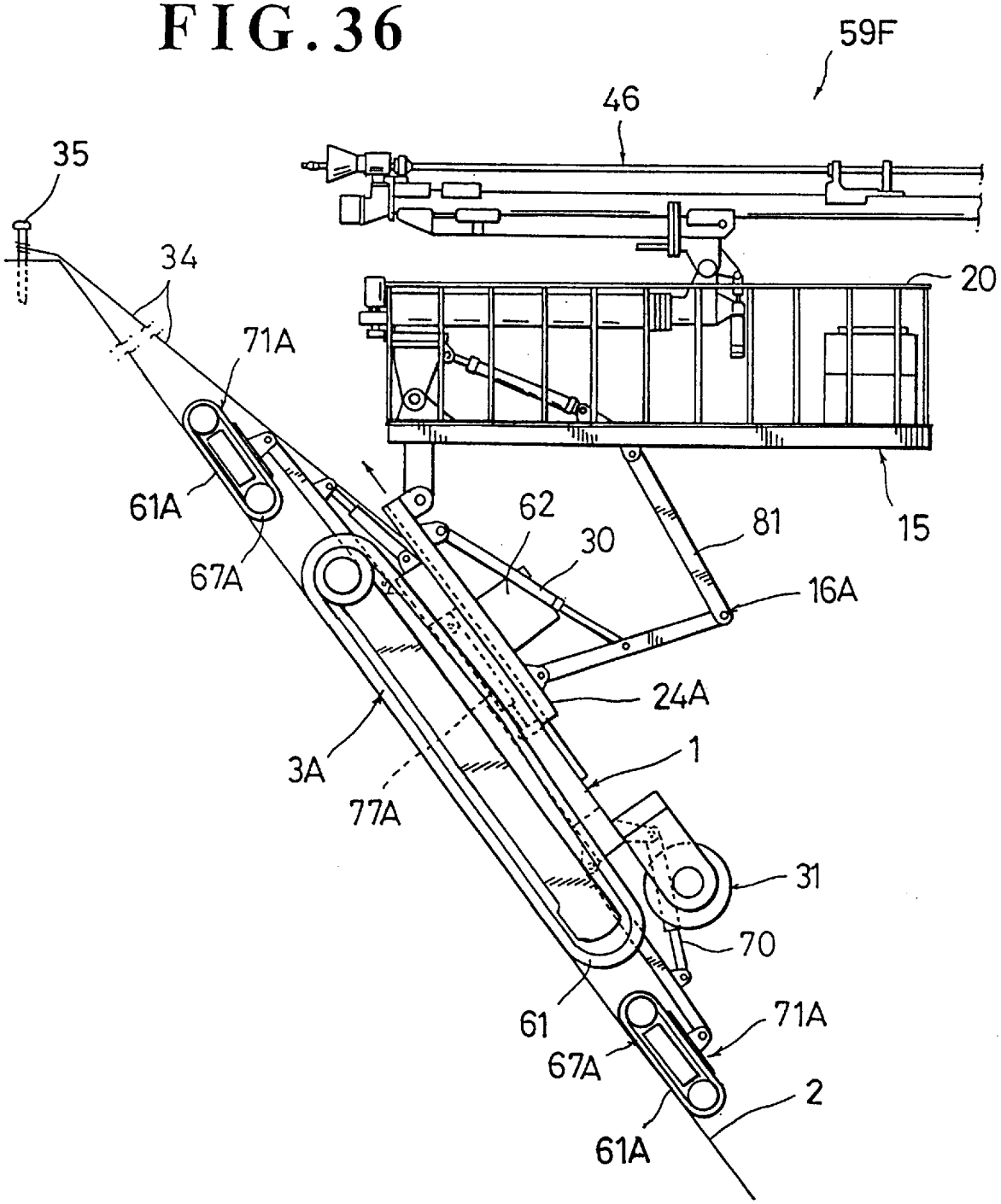
FIG. 36 is an explanatory view of a condition in use showing a seventh embodiment of the present invention.

Moreover, the body 1 can be moved up-, down-, left-, and rightward and conducted at a wide area part on the slope, as shown in FIG. 16, by attaching the end part of the wires 34, 34 rolled up to the drums 33, 33 of left and right winches 31, 31 fixed the body 1, and operating as a suspension device, to the anchor pins 35, 35 fixed the ground to the left and right of the upper position on the slope, and extending or contracting the length of the pulled wires 34, 34 of left and right winches 31,31.

A third embodiment of the present invention shown in FIGS. 17 to 20 is distinguished from the first embodiment by the fact that the work stand support device 16 is replaced with another like device 16A which comprises a support body 74, a work stand removing device 77, a pivot link 81 and an oil hydraulic cylinder for pivoting of the work stand 30. The support body 74 is pivotably mounted by pivot pins 73, 73 to prop members 72, 72 fixed as to jut to both sides, a little to a side part of the front of the body 1, and sustains the work stand 15 in a manner capable of allowing slidable movement forward and backward to the upper part thereof. The work stand removing device 77, such as an oil hydraulic cylinder 76, is positioned to the support body 74, and an operation bar 75 in and out forward and backward is mounted to the work stand 15. Also, the pivot link 81 is pivotably mounted by a pivot pin 80 to the center thereof, one end is mounted by a pivot pin 78 to the portion a little to a back part rather than the center part of the body 1, another is mounted by a pivot pin 79 to the portion a little to a back part of the support body 74. Moreover, oil hydraulic cylinder for pivoting of the work stand 30 is pivoted to the lower link member 81*a* of the pivot link 81, one end is pivotably mounted by a pivot pin 82 to the portion a little to the front of the body 1, another is pivotably mounted by a pivot pin 83 to a nearly center part of the lower link member 81*a*. A slope working machinery 59B with the work stand support device 16A according to the third embodiment will provide the same effects as the first embodiment.

A fourth embodiment of the present invention shown in FIGS. 21 to 24 is distinguished from the third embodiment by the fact that the work stand support device 16A is replaced with another like device 16B which includes props 84, 84 mounted to the portion a little to both sides of the front of the work stand 15 and juts out backward rather than from the bottom of the work tend 15, the end of the props 84, 84 being pivotably mounted by pivot pins 86, 86 to bearing members 85, 85 fixed to the end of the body 1. A slope working machinery 59C with the work stand support device 16B according to the fourth embodiment will provide the same effects as the third embodiment.

A fifth embodiment of the present invention shown in FIGS. 25 to 28 is distinguished from the fourth embodiment by the fact that the work stand support device 16B is replaced with another like device in which a sustaining 24A is mounted to the upper part of the body 1 as to slidably relocate forward and backward, one end being mounted to the body 1 and another being pivotably mounted by a pivot pin 87 to the sustaining 24A, and the end of the props 84, 84 jut out backward rather than from the bottom of the work stand 15 which is pivotably mounted by pivot pins 90, 90 to bearing members 89, 89 fixed to the end of the sustaining 24A. A slope working machinery 59D with such modifications according to the fifth embodiment will provide the same effects as the fourth embodiment.

A sixth embodiment of the present invention shown in FIGS. 29 to 32 is distinguished from the fifth embodiment by the fact that the running device 3 is replaced with another like device which comprises caterpillars 61, 61 mounted to both sides of the body 1 and an oil hydraulic driving gear device 62 used to operate the working machines, such as an oil hydraulic backhoe, capable of driving of the caterpillars 61, 61. A slope working machinery 59E with the running device 3A according to the sixth embodiment will provide the same effects as the fifth embodiment.

A seventh embodiment of the present invention shown in FIGS. 33 to 36 is distinguished from the sixth embodiment by the fact that fall down-prevention devices 71A, 71A having caterpillars 61A, 61A are mounted to front and rear parts of the body 1. A slope working machinery 59F with the fall down-prevention devices 71A, 71A according to the seventh embodiment will provide the same effects as the sixth embodiment.

The fall down-prevention devices 71A, 71A comprise fall down-prevention members 67A, 67A and oil hydraulic cylinders 70,70 as a pushing pressure device. The fall down-prevention members 67A, 67A include the pivot arms 5,5, pivotably mounted by the pivot pins 4, 4 upward and downward to front and rear part of the body 1, the play end parts jut out forward and backward of the body 1, and the caterpillars 61A, 61A drives with oil hydraulic drive gear device 62, pivotably mounted by pivot pins 91, 91 to the end of the pivot arms 5, 5. The oil hydraulic cylinders 70, 70 can always press the play end part of the fall down-prevention members 67A, 67A to the ground with fixed pressure, one end being pivotably mounted by pivot pins 68, 68 to the portion a little to the end part of the pivot arms 5, 5, another being pivotably mounted by pivot pins 69, 69 to the portion capable of pivoting of the pivot arms 5, 5, of the body 1.

Figure 37:
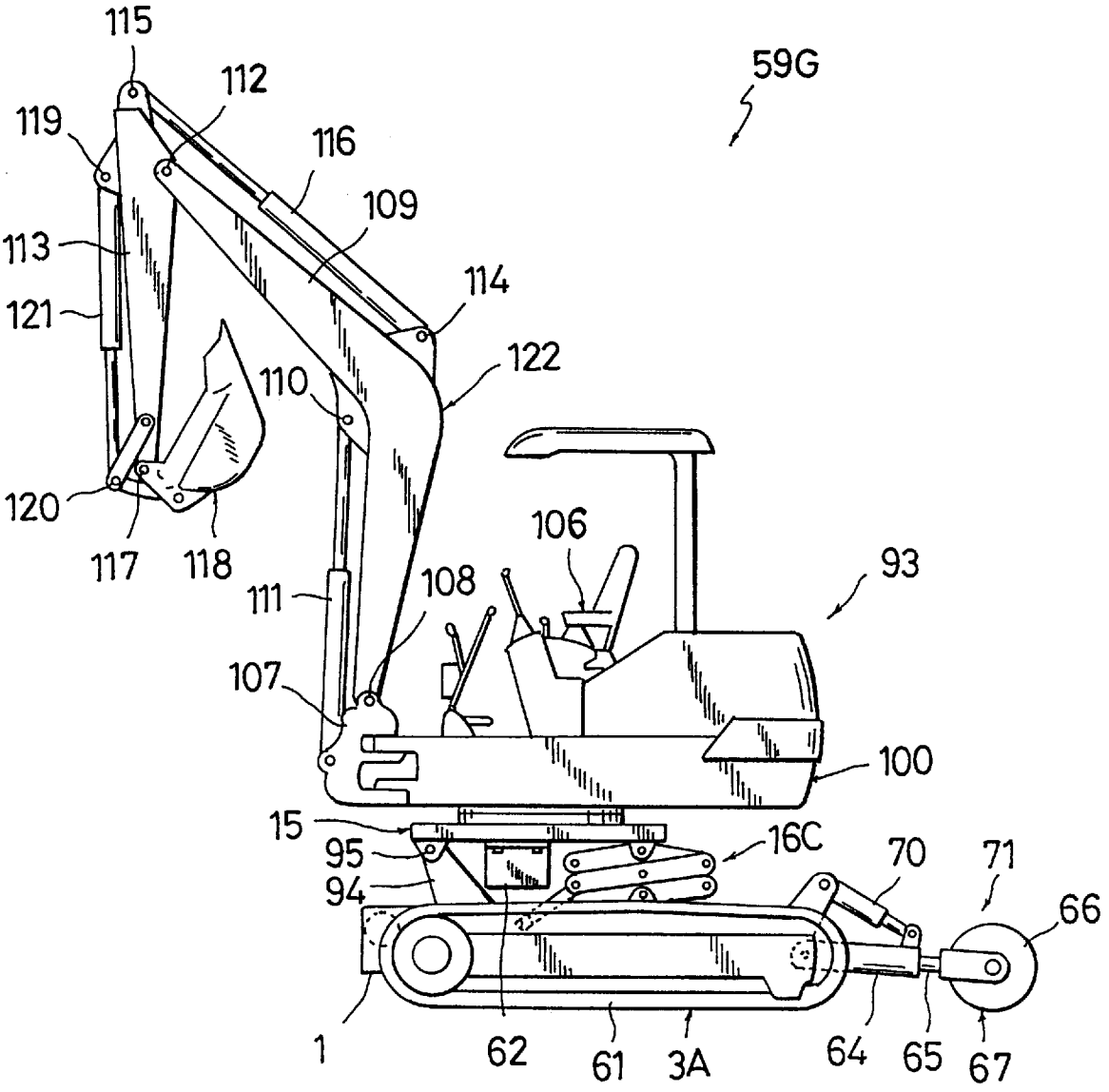
FIG. 37 is a side view showing an eighth embodiment of the present invention.
Figure 38:
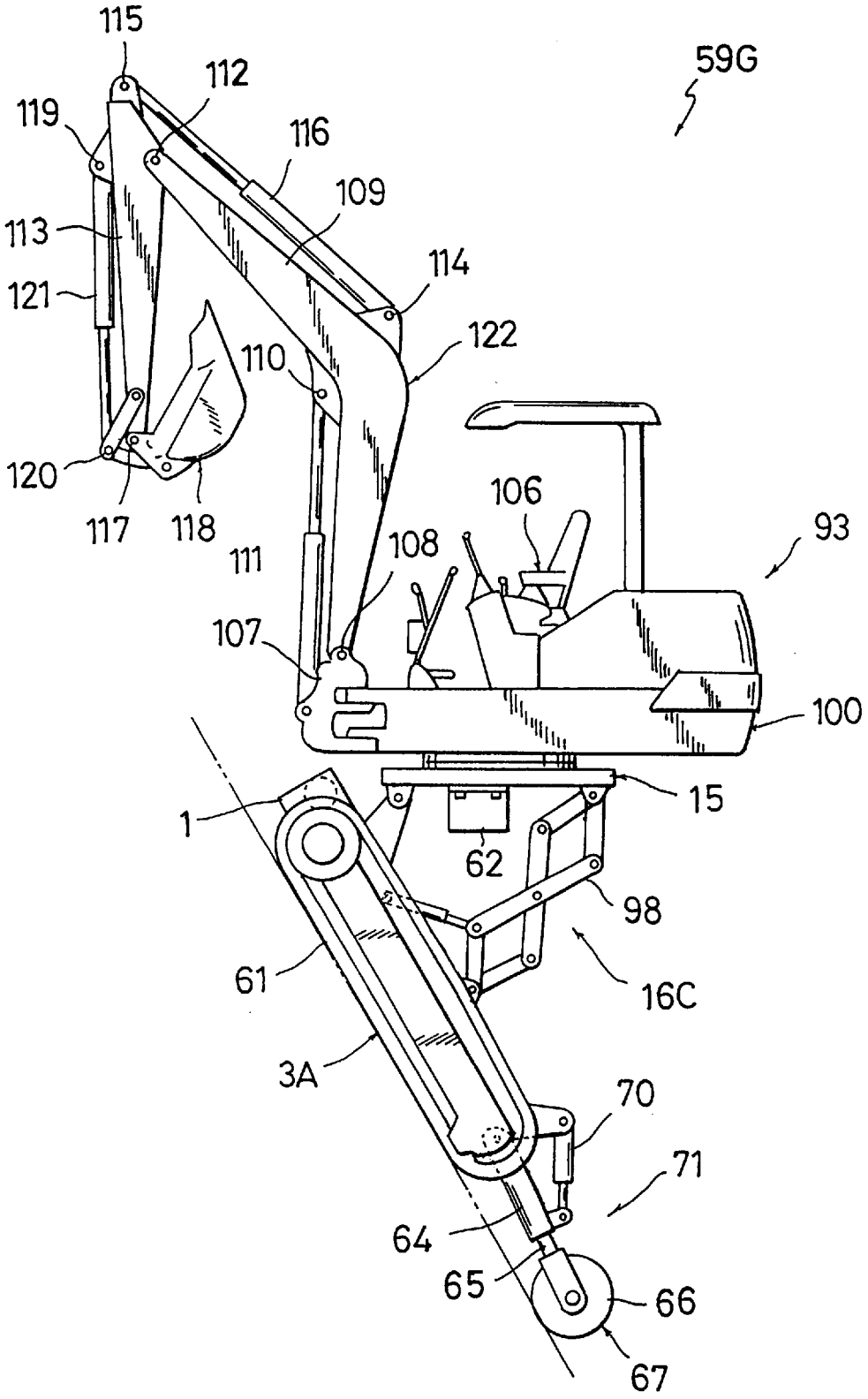
FIG. 38 is an explanatory view of a pivoted condition of a work stand showing an eighth embodiment of the present invention.
Figure 39:
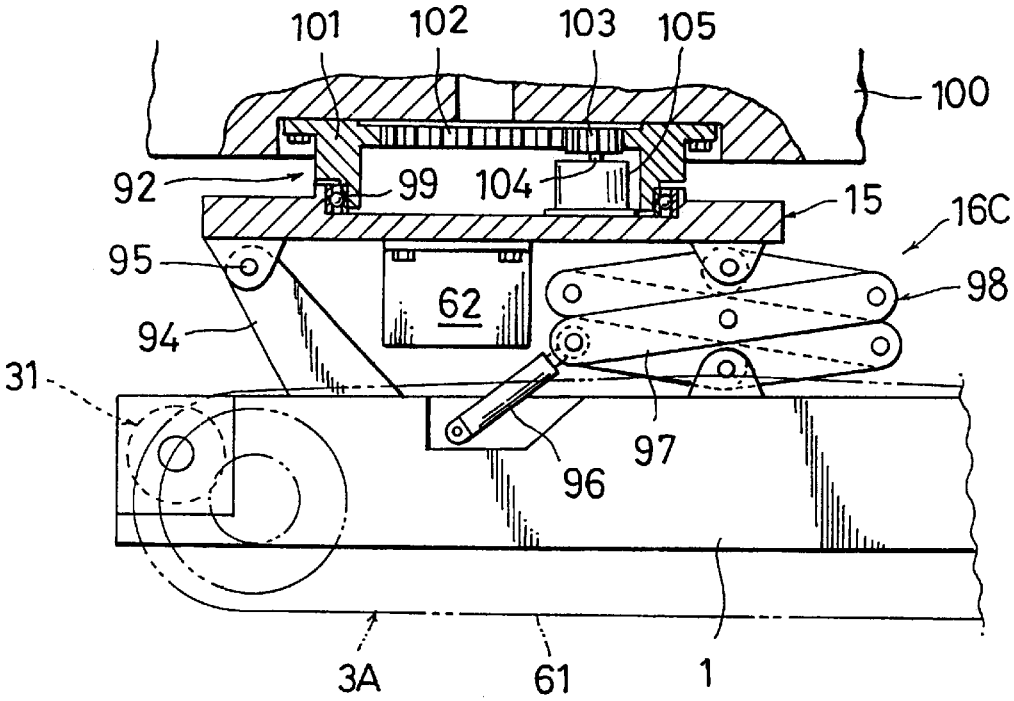
FIG. 39 is an explanatory view of a pivot means showing an eighth embodiment of the present invention.
Figure 40:
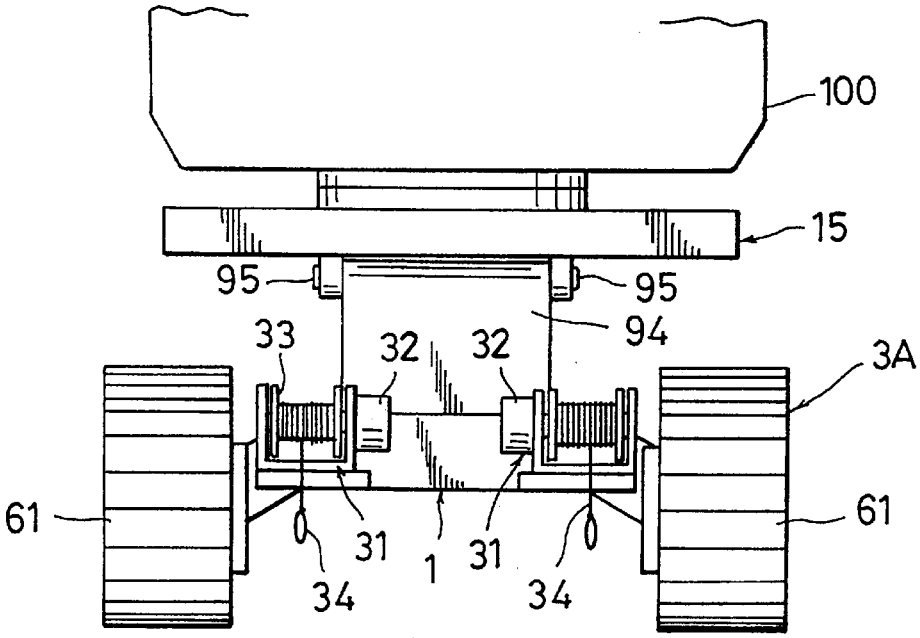
FIG. 40 is mainly front view showing an eighth embodiment of the present invention.
Figure 41:
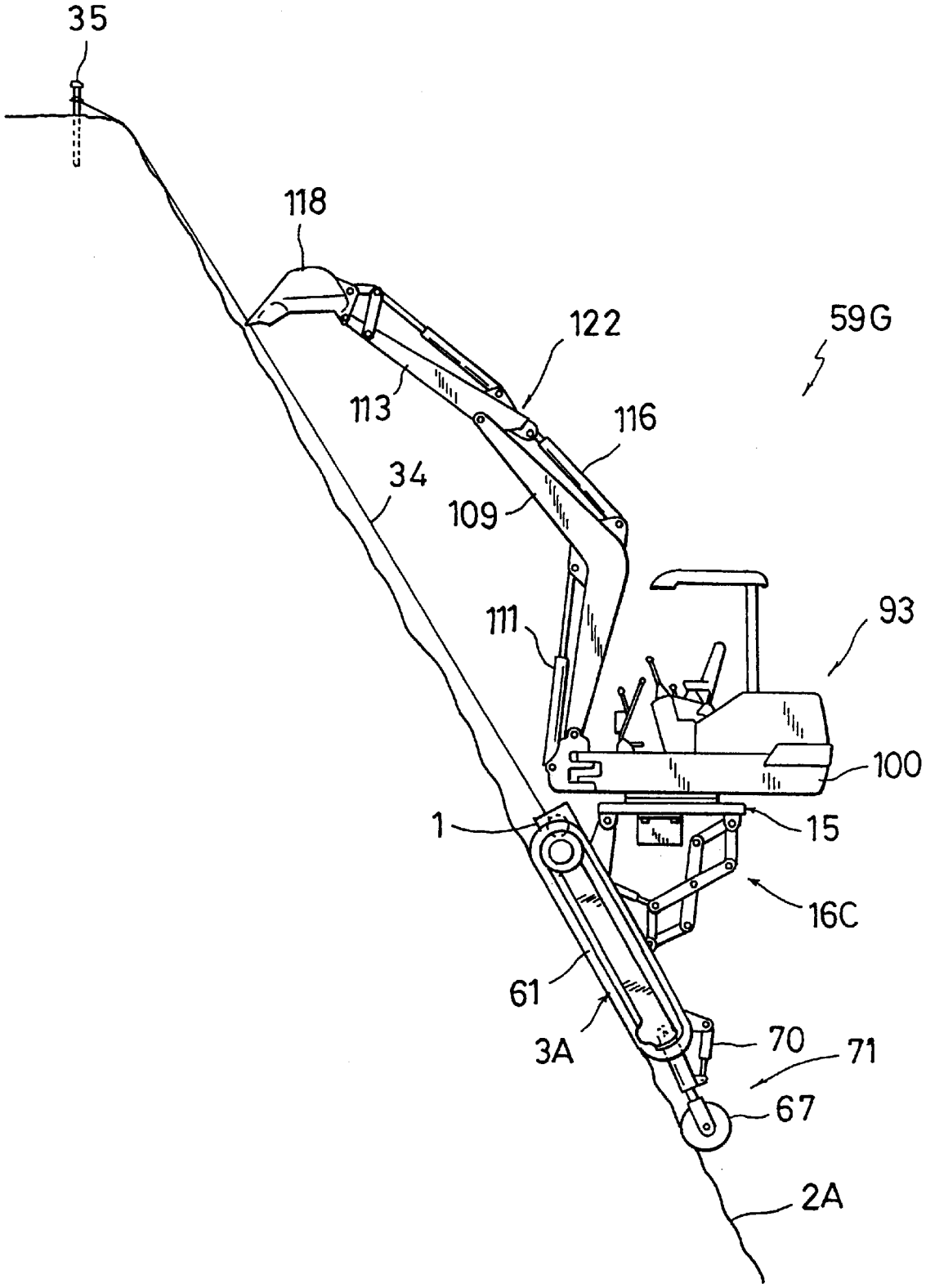
FIG. 41 is an explanatory view of a condition in use showing an eighth embodiment of the present invention.

An eighth embodiment of the present invention shown in FIGS. 37 of 41 is distinguished from the second embodiment by the fact that the work stand support device 16 is replaced with another like device 16C which is comprises a working machine 93 mounted to the work stand 15 through a revolving means 92 in an analogous manner as a known backhoe and a pivot means 98. The pivot means 98 is pivotably mounted the front of the work stand by pivot pins 95, 95 to a support stand 94 which is fixed to the front part of the body 1, and mounted to the rear part of the work stand 15, using a link 97 in the slope of a pantograph which extends and contracts by the oil hydraulic cylinder 96. A slope working machinery 59G having the work stand support device 16C according to the eighth embodiment can be moved to maintain a nearly horizontal position of the work machine 93 on a slope 2A and to conduct operations to level and/or dig earth and sand.

The revolving means 92 is comprised of a cylindrical revolving axle 101, an inner gear 102 and an oil hydraulic motor 105. The cylindrical revolving axle 101 is pivotably mounted through a bearing 99 to the work stand 15 and fixed to the bottom of a base stand 100 of the working machine 93. The inner gear 102 is formed on an inside wall of the cylindrical revolving axle 101. Also a pinion 103 which gears with the inner gear 102 is mounted to a driving gear 104 and the oil hydraulic motor 105 is fixed to the work stand 15 positioned into the inner gear 102.

The working machine 93 is comprised of a driving seat 106 arranged to the upper part of the base stand 100 and a driving arm 122. The driving arm 122 comprises a link in the shape of a boomerang 109, an oil hydraulic cylinder for pivoting of the link 111, a pivoting boom 113, an oil hydraulic cylinder for the pivoting boom 116, a bucket 118, and an oil hydraulic cylinder for pivoting of the bucket 121. The link in the shape of a boomerang 109 is pivotably mounted by a pivot pin 108 to a support clasp 107 fixed to a nearly center part of the front part of the base stand 100. One end of the oil hydraulic cylinder for pivoting of the link 111 is pivotably mounted to the support clasp 107 and another end is pivotably mounted by a pivot pin 110 to a nearly center part of the link 109. The portion of the back end part of the pivot boom 113 is pivotably mounted by a pivot pin 112 to the end part of the link 109. One end of the oil hydraulic cylinder for the pivoting boom 116 is pivotably mounted by a pivot pin 114 to the nearly center part of the link 109, and another end is pivotably mounted by a pivot pin 115 to the back end part of the pivot boom 113. The bucket 118 as an attachment for working is pivotably mounted by a pivot pin 117 to the end of the pivot boom 113. Also one end of the oil hydraulic cylinder for the pivoting of the bucket 121 is pivotably mounted by a pivot pin 119 to a nearly center part of the pivot boom 113 and another end is pivotably mounted by a pivot pin 120 to the back part of the bucket 118.

Figure 42:
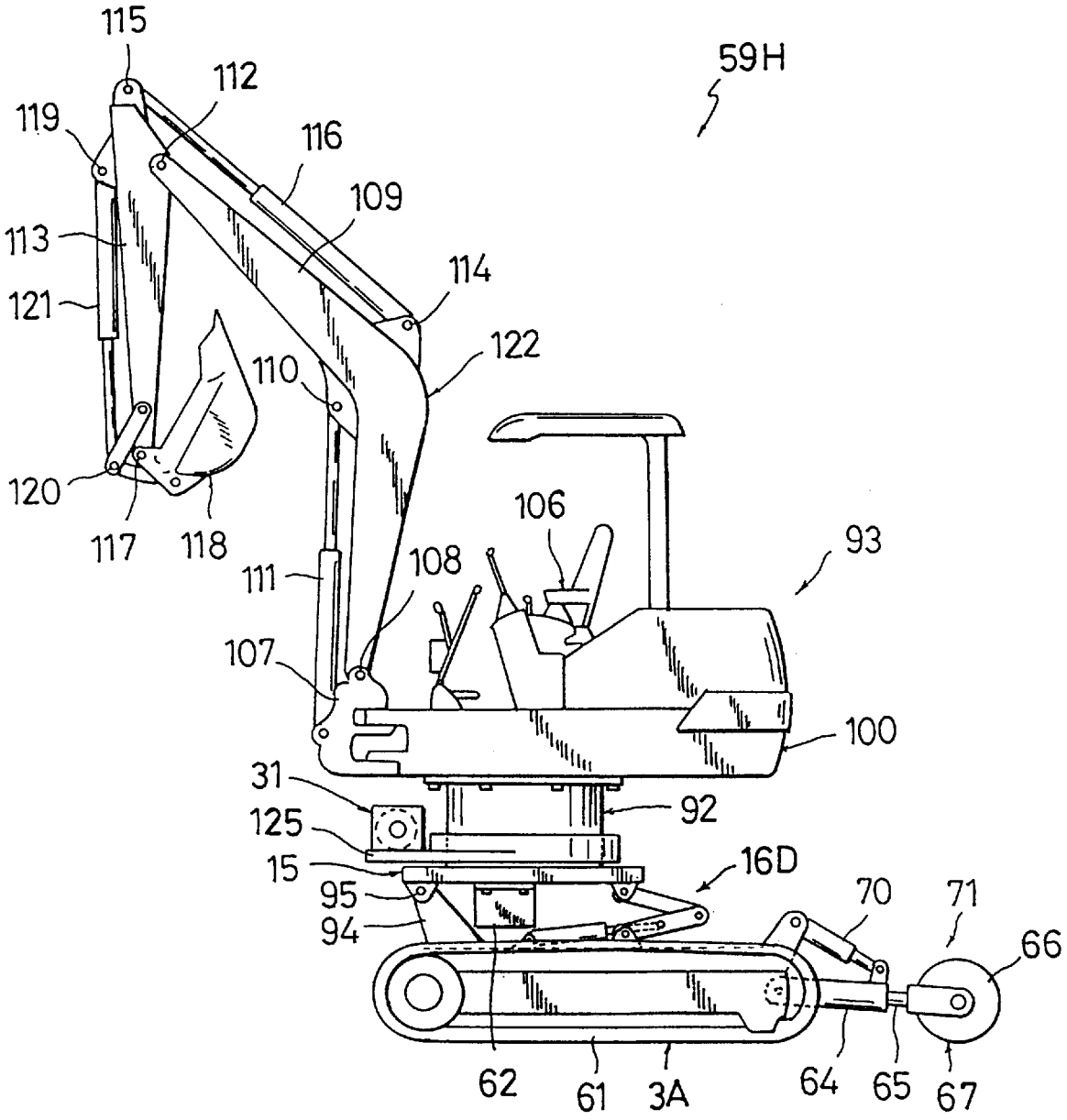
FIG. 42 is a side view showing a ninth embodiment of the present invention.
Figure 43:
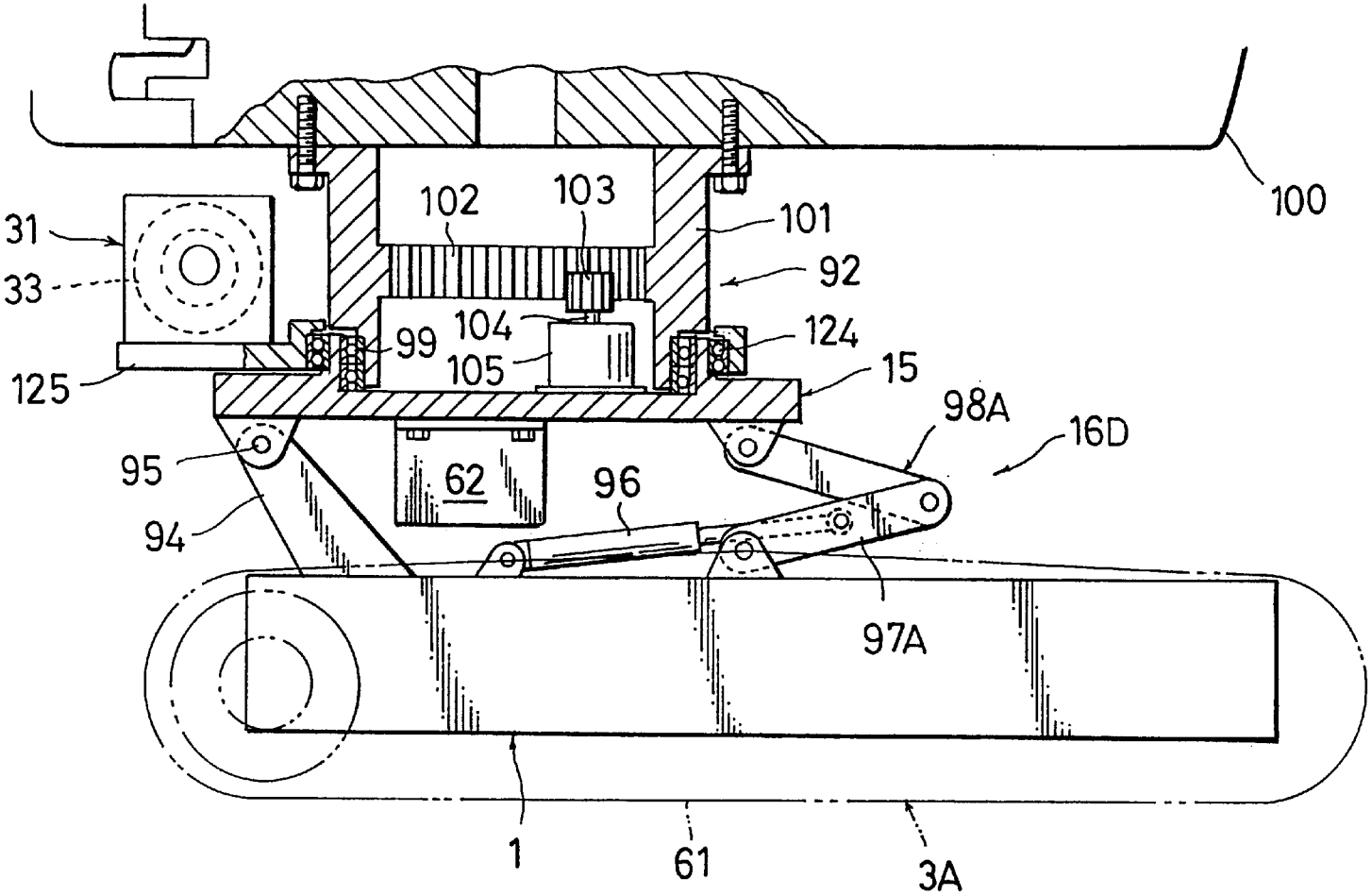
FIG. 43 is an explanatory view of a pivot means showing a ninth embodiment of the present invention.
Figure 44:
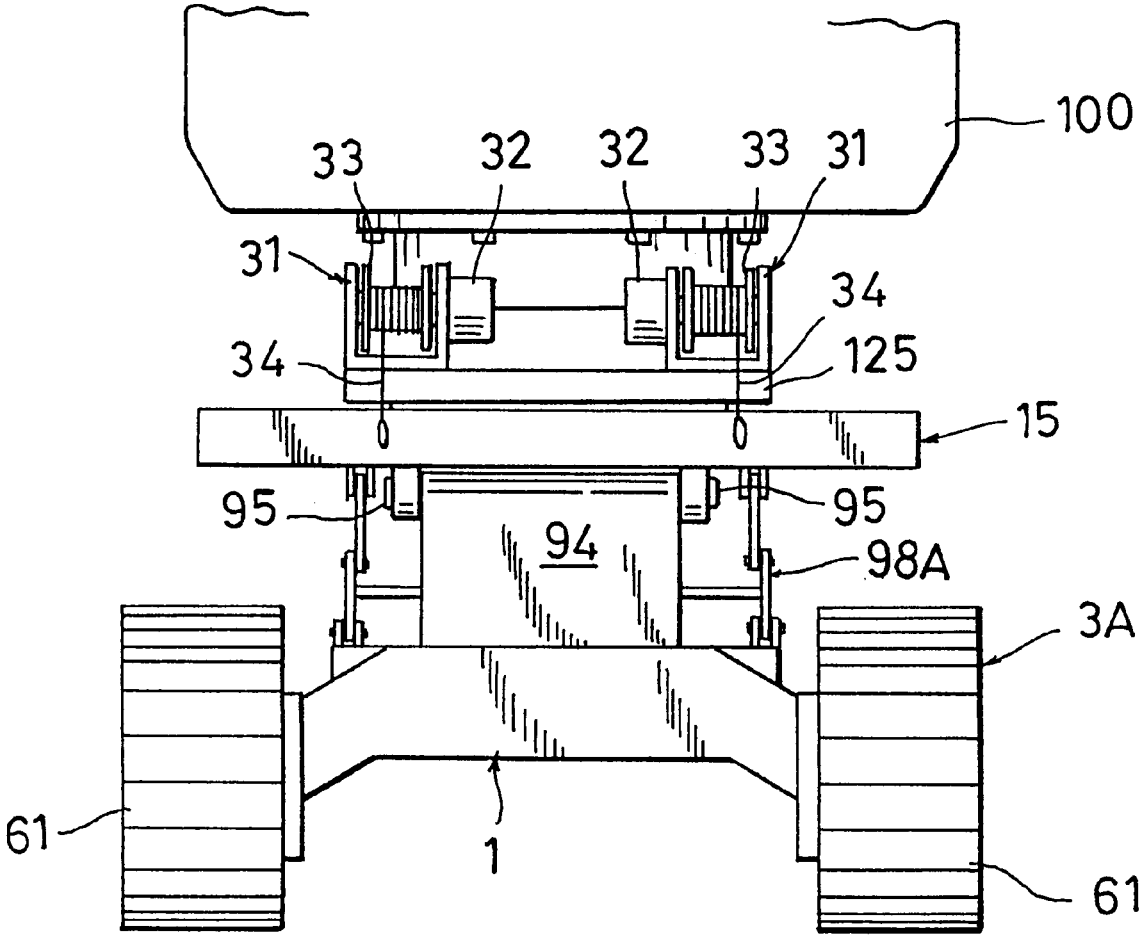
FIG. 44 is mainly front view showing a ninth embodiment of the present invention.

A ninth embodiment of the present invention shown in FIGS. 42 to 44 is distinguished from the eighth embodiment by the fact that the work stand support device 16C is replaced with another like device 16D with a pivot means 98A using a link 97A pivoted by a pivot pin 123 to the center thereof, and the left and right winches 31, 31 as suspension device is pivotably mounted to both sides of front part of pivot board 125 pivotably mounted through a bearing 124 to the work stand 15. A slope working machinery 59H having such modifications according to the ninth embodiment will provide the same effects as the eighth embodiment, and thus, both wires 34, 34 with the suspended left and right winches 31, 31 can be always added automatically equal power by pivoting of the pivot board 125.

Figure 45:
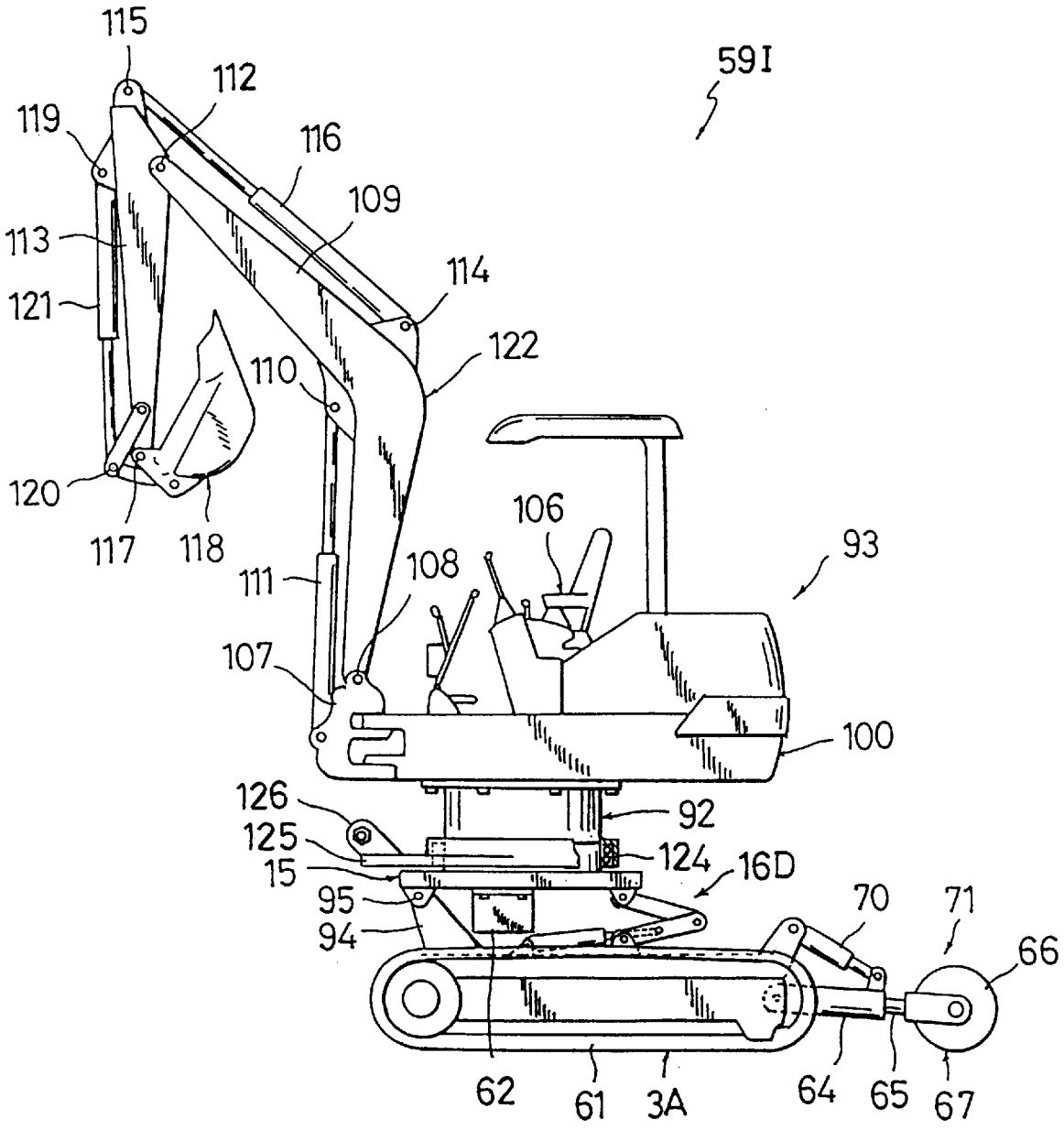
FIG. 45 is a side view showing a tenth embodiment of the present invention.
Figure 46:
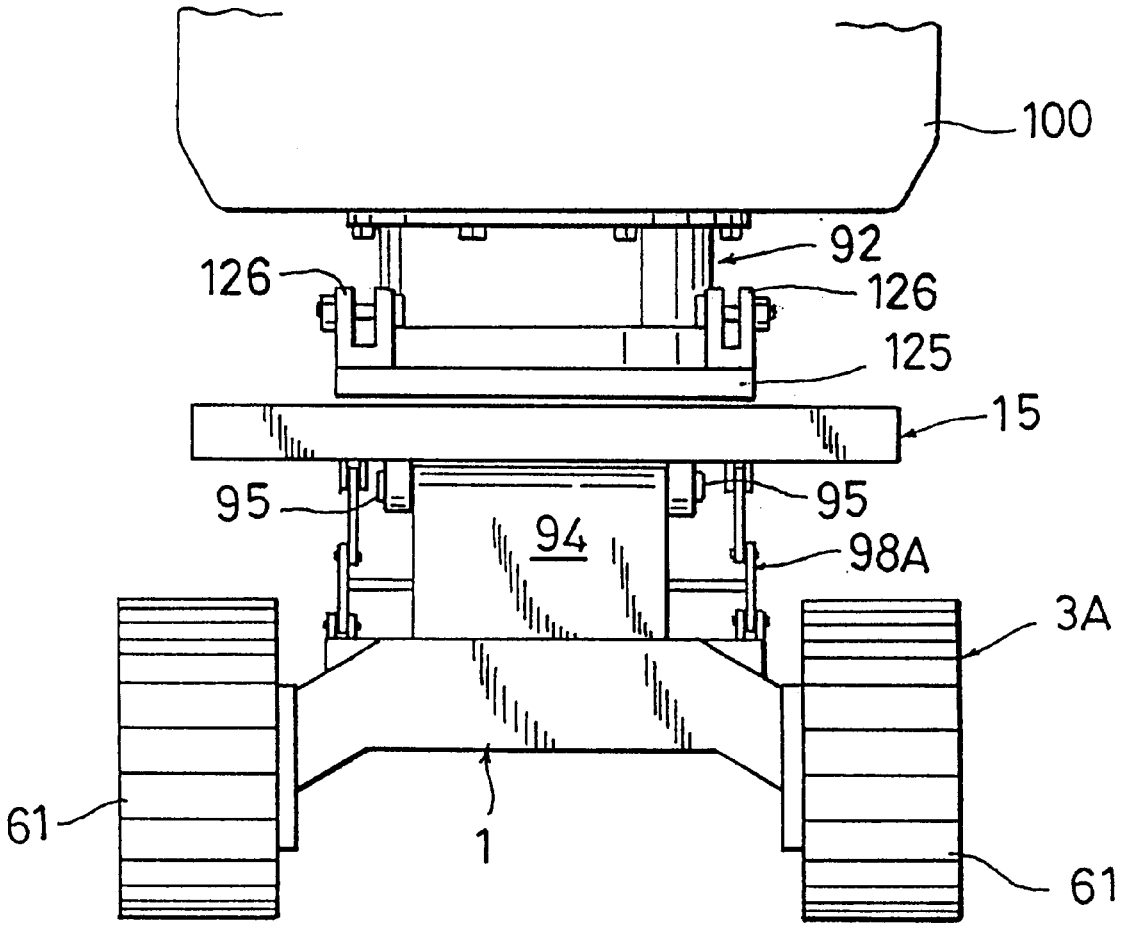
FIG. 46 is mainly front view showing a tenth embodiment of the present invention.
Figure 47:
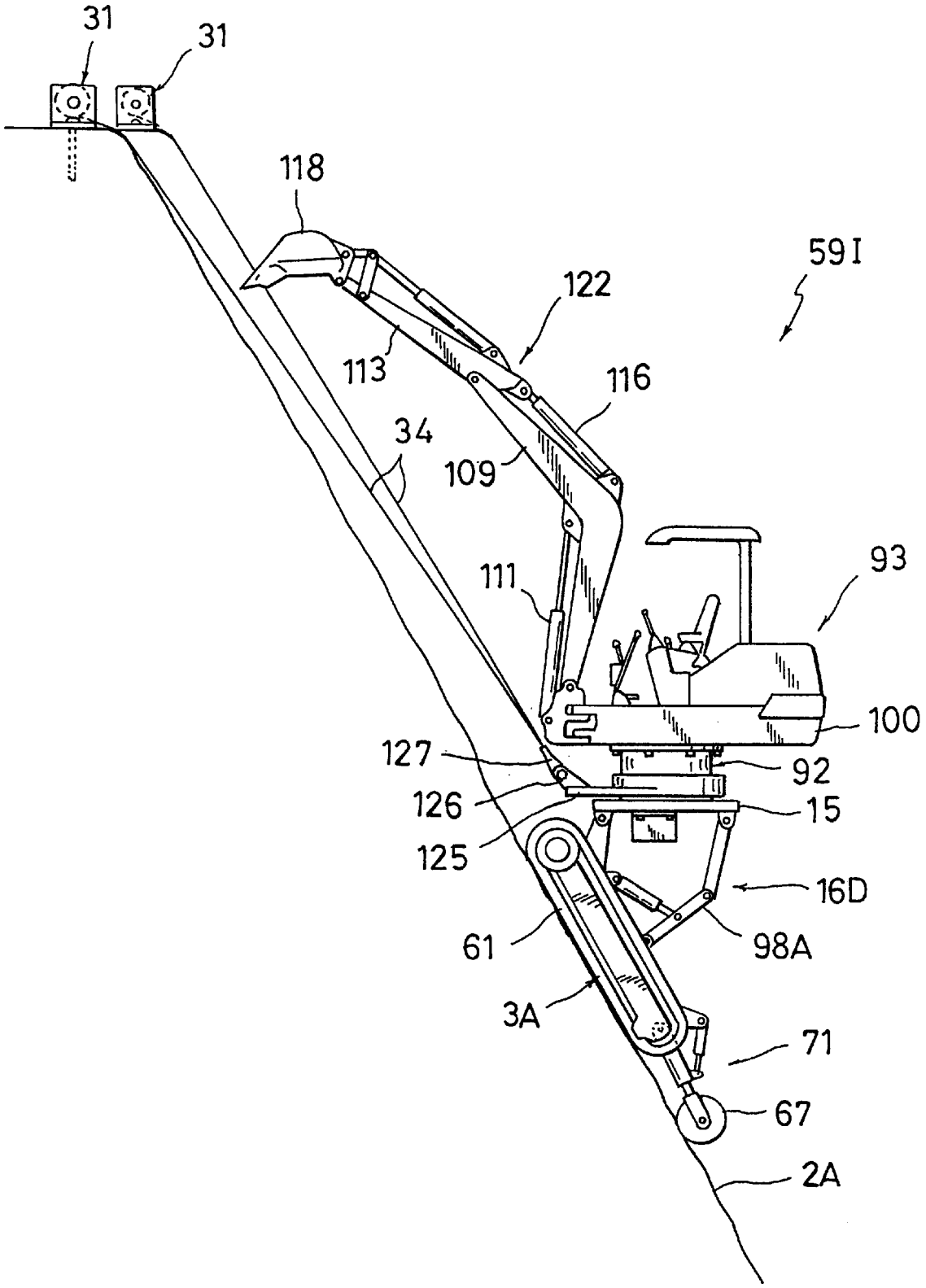
FIG. 47 is an explanatory view of a condition in use showing an eighth embodiment of the present invention.

A tenth embodiment of the present invention shown in FIGS. 45 to 47 is distinguished from the ninth embodiment by the fact that wire clasps 126, 126 are mounted to the portion a little to both sides of the front of a pivot board 125 and clasp projections 127, 127 are provided which are fixed to the end part of the wires 34, 34 of the left and right winches 31, 31 which are in turn fixed at left and right portions of the upper part of the slope 2A. A slope working machinery 591 with such device according to the tenth embodiment will provide the same effects as the ninth embodiment.

Figure 48:
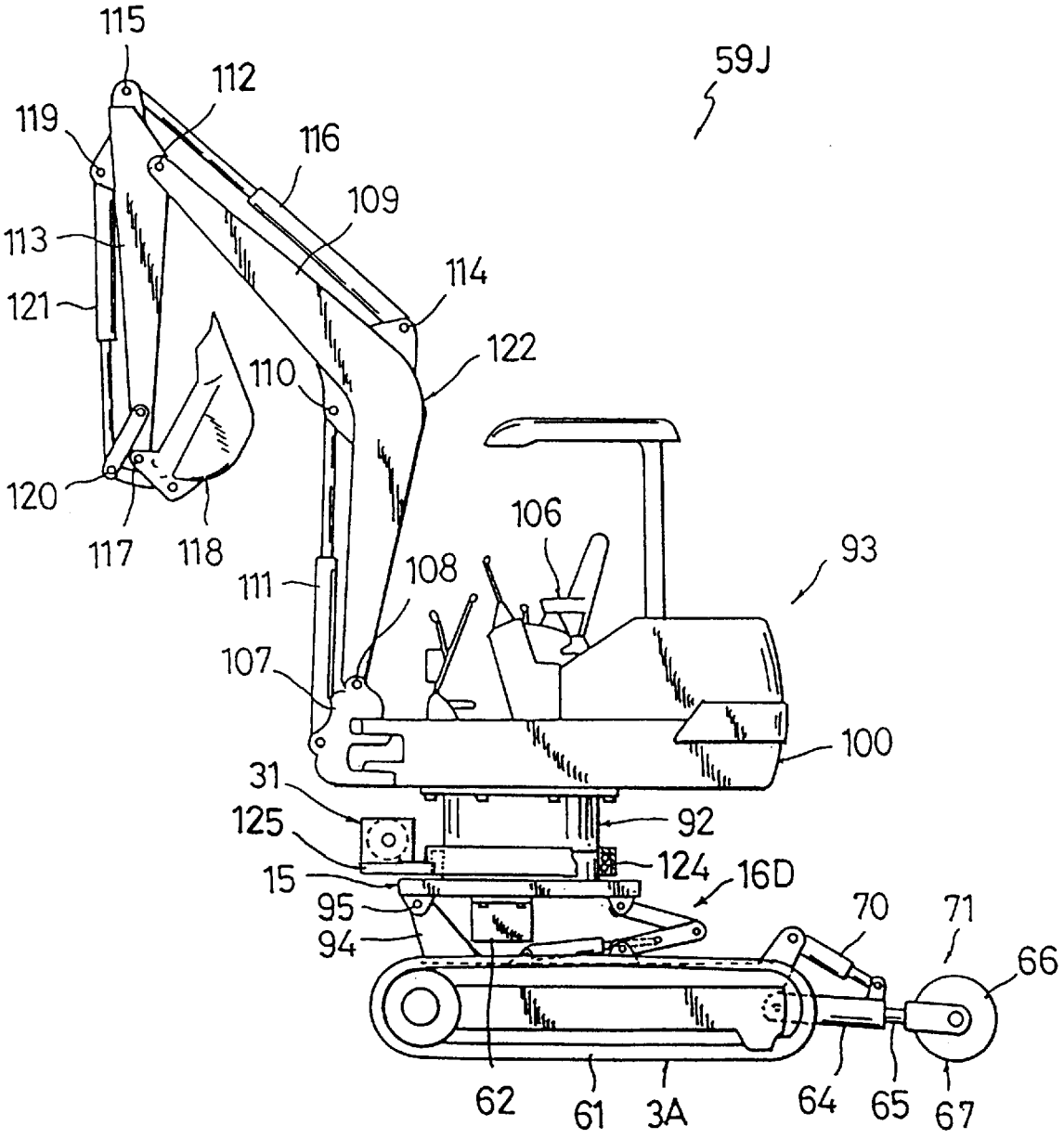
FIG. 48 is a side view showing an eleventh embodiment of the present invention.
Figure 49:
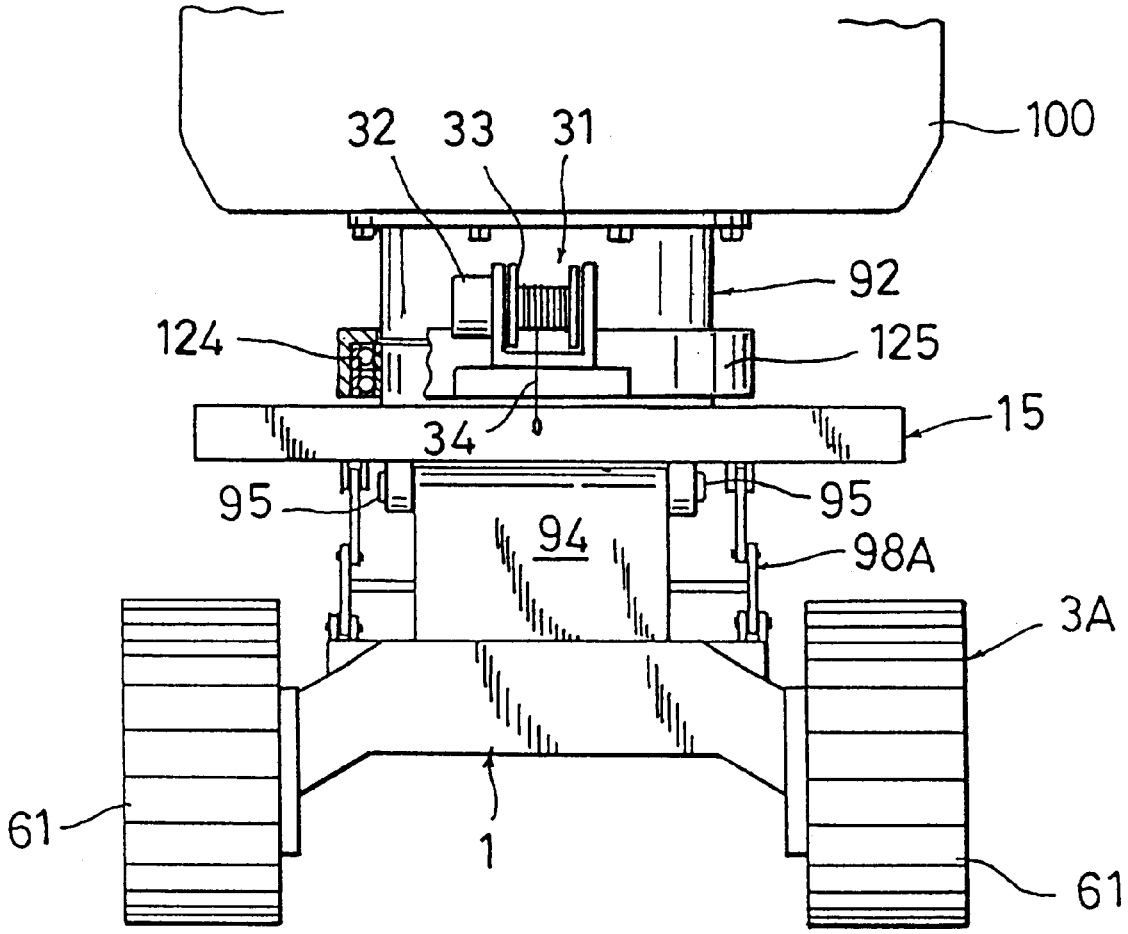
FIG. 49 is mainly front view showing an eleventh embodiment of the present invention.
Figure 50:
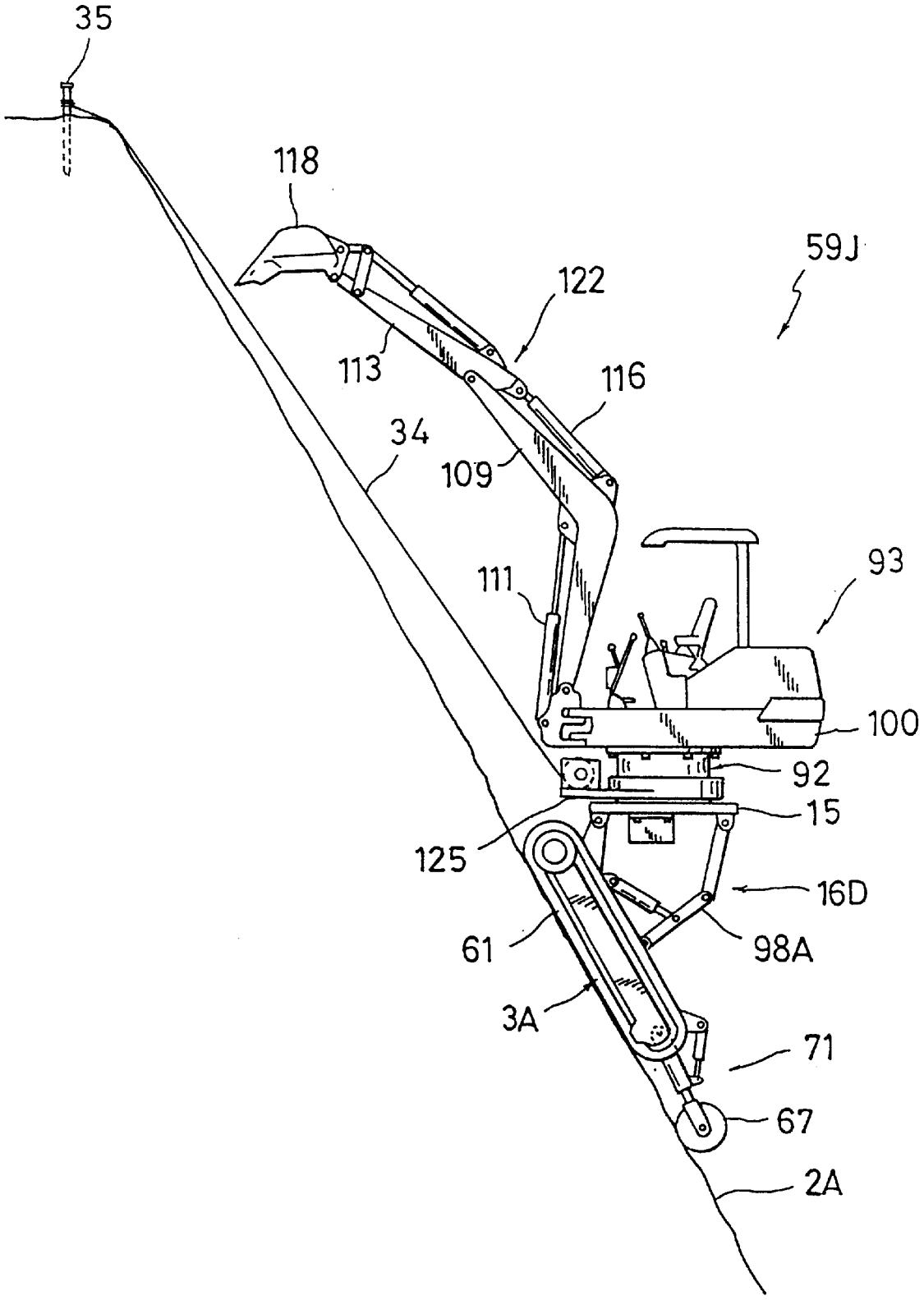
FIG. 50 is an explanatory view of a condition in use showing an eleventh embodiment of the present invention.

An eleventh embodiment of the present invention shown in FIGS. 48 to 50 is distinguished from the ninth embodiment by the fact that one of the winches 31, 31 is mounted to the center part of the front of the pivot board 125. A slope working machinery 59J having such suspension device according to the tenth embodiment can not be moved widely leftward and rightward on the slope 2A but can be used to move through a narrow area leftward and rightward and worked on the slope 2A.

Figure 51:
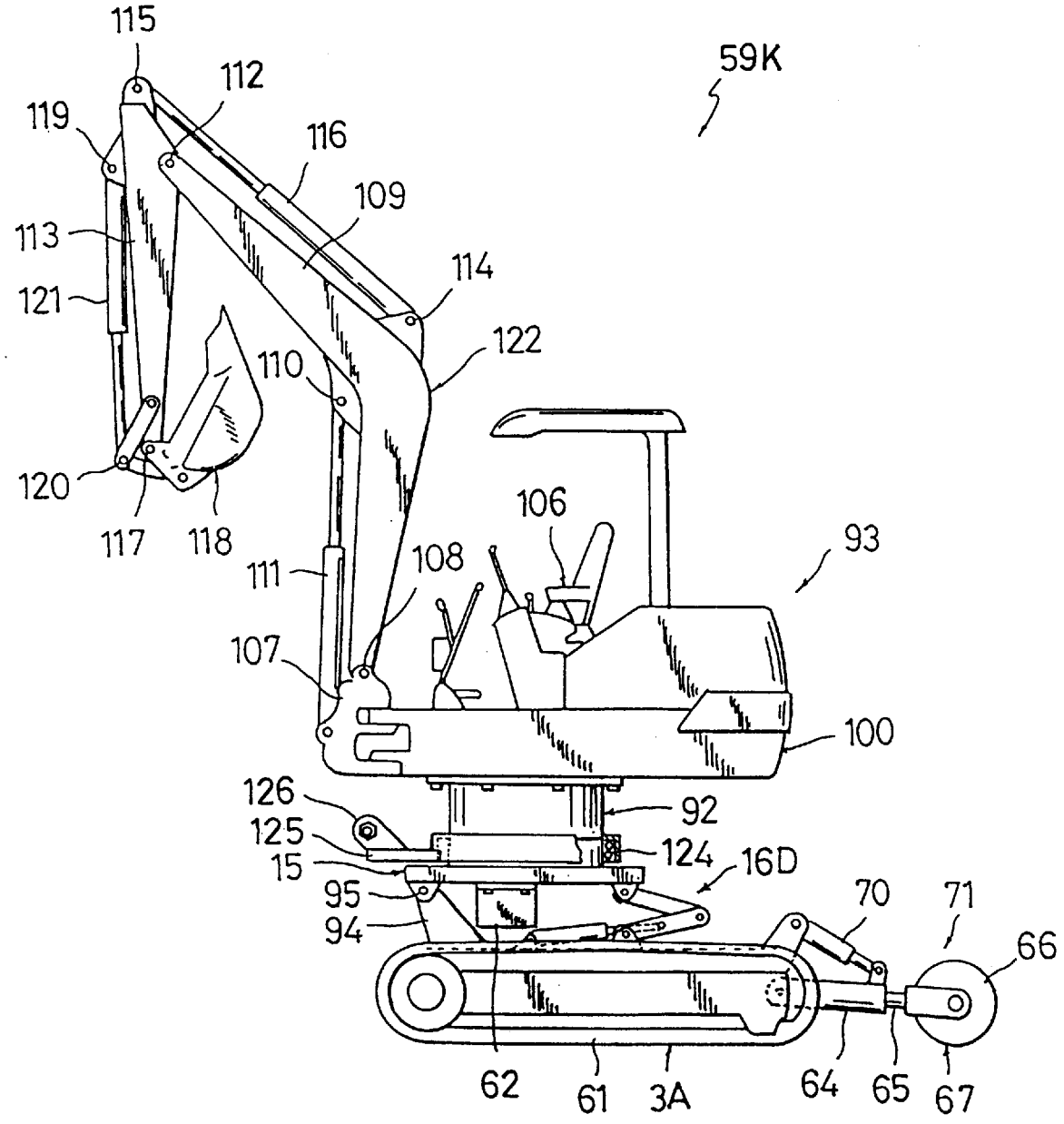
FIG. 51 is a side view showing an eleventh embodiment of the present invention.
Figure 52:
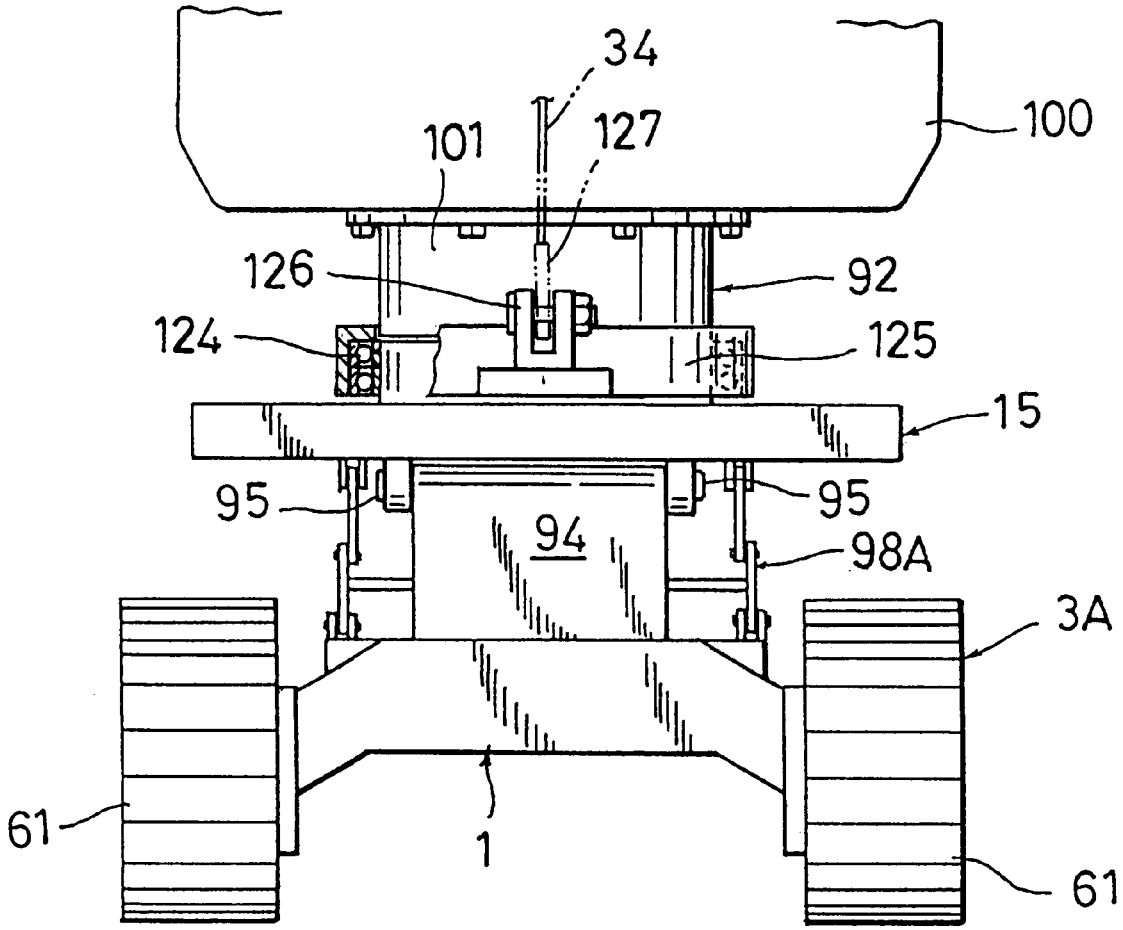
FIG. 52 is mainly front view showing a twelfth embodiment of the present invention.
Figure 53:
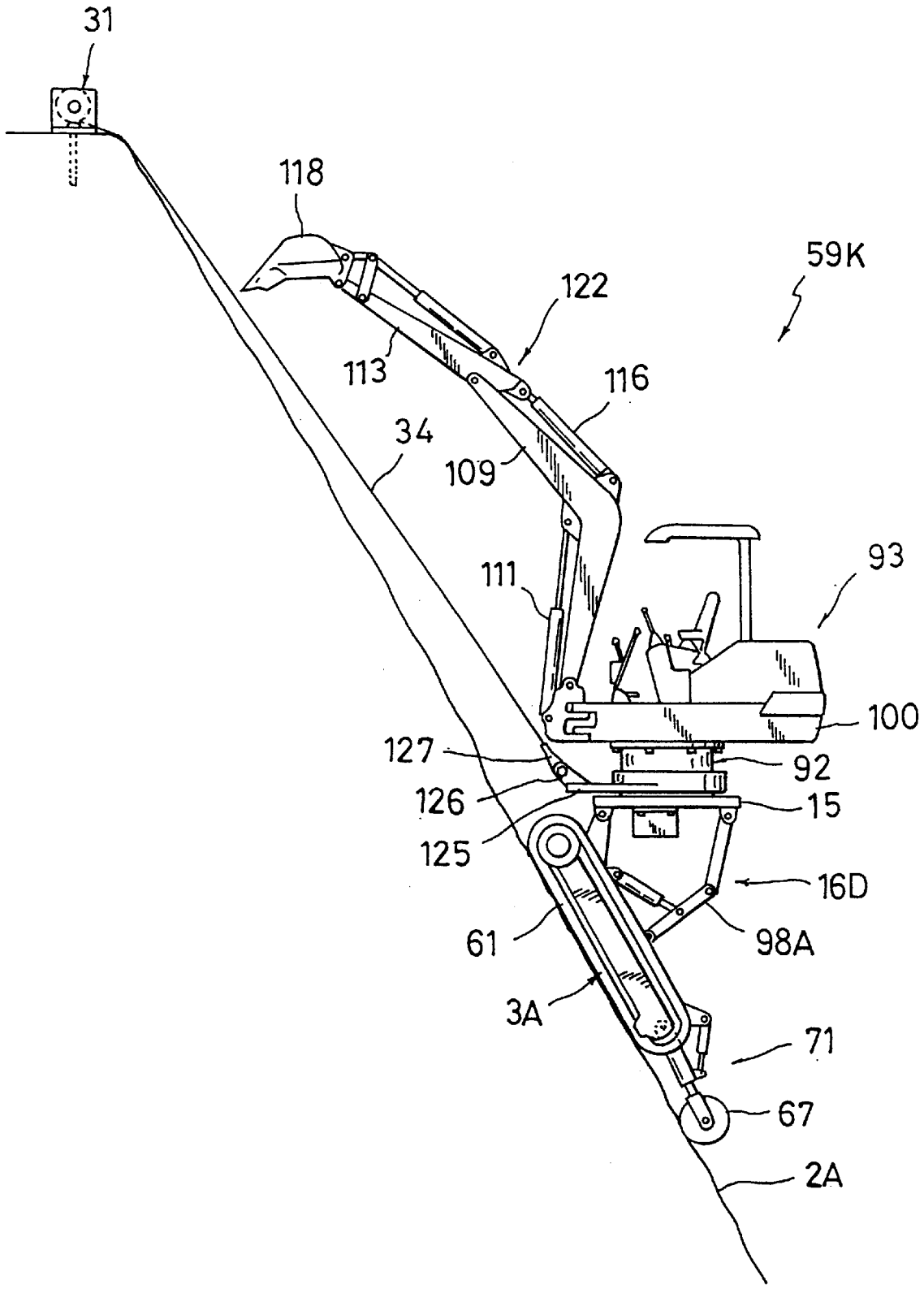
FIG. 53 is an explanatory view of a condition in use showing a twelfth embodiment of the present invention.

A twelfth embodiment of the present invention shown in FIGS. 51 to 53 is distinguished from the eleventh embodiment by the fact that a wire clasp 126 is mounted on the center part of the front of the pivot board 125, and the wire clasp 126 is provided as to be able to fix the clasp projection fixed to the end part of the wire 34 of the winch 31 fixed to the upper position on the slope 2A. A slope working machinery 59K having such suspension device according to the twelfth embodiment will provide the same effects as the eleventh embodiment.

Additionally, a slope working machinery may may include left and right wire clasps mounted to the body in spite of the left and right winches with the suspension device and used with a suspension device having left and right winches fixed to the left and right portions of the upper of a slope in the first, second, third, fourth fifth, sixth and seventh embodiments of the present invention.

Moreover, although the slope working machinery uses an air hydraulic cylinder to conduct various working in each embodiment of the present invention, the slope working machinery may alternatively use an air cylinder and/or various movement devices using electric motors as a driving gear device.

As set forth above, the advantages of the present invention are as follows:

(1) A slope working machinery of the present invention comprises: a body; a running device made to be able to travel on a slope, attached to the body; a work stand positions to the upper part of the body; a work stand support device mounted between the body and the work stand as to position the work stand nearly horizontally; and a suspension device with one or more winches attached as to be able to sustain by the condition which hung down the body from the upper position on a slope.

Accordingly, the slope working machinery can be travelled on on a steep slope using the suspension device with one or more winches and conducted to work on the slope.

As a result, it is necessary to establish an old scaffold, and the working on the slope will be conducted with efficiency in a short time period.

(2) As discussed above, the work stand can be positioned nearly horizontally by using the work stand support device.

Therefore, workers can work safely and comfortably on the work stand.

(3) By using left and right winches as a suspension device and the left and right anchor pins fixed to left and right parts of the upper part of the slope, a body is made to be able to travel up-, down-, left-, and rightward on the slope.

Therefore, the slope working machinery can be conducted with efficiency at through a wide area part on the slope.

(4) An engine can be always positioned nearly horizontally by attaching the engine comprising a part of the working machinery to the work stand.

Therefore, the slope working machinery can be prevented from burning out the engine by sloping a position of the engine as before and to therefor prevent continued operation.

What is claimed is:

1. A slope working machinery comprising:

a body;

a running device capable of travel on a slope, said running device being attached to said body;

a work stand positioned to an upper part of said body;

a work stand support device mounted between said body and said work stand for positioning said work stand nearly horizontally;

at least one fall down-prevention device mounted to said body, said at least one fall down-prevention device including a rollable portion contactable with a supporting surface for inhibiting capsizing of said body; and a suspension device including at least one winch including a wire supportably extending between said body and an upper position on a slope for sustaining a condition of said body.

2. A slope working machinery according to claim 1, wherein said running device includes an oil hydraulic device and a caterpillar drivable by said oil hydraulic device.

3. A slope working machinery according to claim 1, wherein said running device includes wheels mounted to both sides in front and rear parts of said body capable of turning and an oil hydraulic motor for driving at least one of said wheels.

4. A slope working machinery according to claim 1, wherein said work stand support device includes a link which pivotably connects a front of said work stand to a front part of said body, said work stand pivotably extending and contracting by using an oil hydraulic cylinder pivotably connected to a rear of said work stand and a little to a rear part of said body.

5. A slope working machinery according to claim 1, wherein said work stand support device includes a device capable of shifting a center of gravity of said work stand to a front thereof by slidable relocation of said work stand with respect to said body after said work stand is positioned nearly horizontally on the slope by pivoting thereof relative said body.

6. A slope working machinery according to claim 1, wherein said suspension device includes a winch attached to a center part of said body and an anchor pin fixed to the upper position on the slope capable of attaching to a wire of said winch.

7. A slope working machinery according to claim 1, wherein said suspension device includes a winch fixed to the upper position on the slope and a wire fixation clasp mounted to a nearly center portion of a front of said body to which a projection fixed to the end of the wire rolled up by said winches is fixably engageable.

8. A slope working machinery comprising:

a body;

a running device capable of travel on a slope, said running device being attached to said body;

a work stand positioned to the upper part of said body;

a work stand support device mounted between said body and said work stand for positioning said work stand nearly horizontally;

at least one fall down-prevention device mounted to said body, said at least one fall down-prevention device including a rollable portion contactable with a supporting surface for inhibiting capsizing of said body;

a working device, for the slope, mounted on said work stand; and a suspension device for providing suspended support of said body from an upper position on the slope to maintain a condition of said body.

9. A slope working machinery according to claim 8, wherein said suspension device includes a winch attached to the center part of said body, and an anchor pin fixed to the upper position on the slope, capable of attaching to a wire of said winch.

10. A slope working machinery according to claim 8, wherein said suspension device includes a winch fixed to the upper position on the slope and a wire fixation clasp mounted to a nearly center portion of a front of said body to which a projection fixed to the end of the wire rolled up by said winches is fixably engageable.

11. A slope working machinery according to claim 8, wherein said working device includes an engine mounted to said work stand, an oil hydraulic pump mounted to said work stand drivable by said engine and a hole making device which works with oil pressure from said oil hydraulic pump.

12. A slope working machinery according to claim 8, wherein said working device includes a base stand attached to said work stand capable of revolving, a driving seat and a driving arm which is pivotably mounted to said base stand having a bucket mounted to the end thereof.

13. A slope working machinery according to claim 8, wherein said running device includes an oil hydraulic device and a caterpillar drivable bv said oil hydraulic device.

14. A slope working machinery according to claim 8, wherein said running device includes wheels mounted to both sides in front and rear parts of said body capable of turning and an oil hydraulic motor for driving at least one of said wheels.

15. A slope working machinery according to claim 8, wherein said work stand support device includes a link which pivotably connects a front of said work stand to a front part of said body, said work stand pivotably extending and contracting by using an oil hydraulic cylinder pivotably connected to a rear of said work stand and a little to a rear part of said body.

16. A slope working machinery according to claim 8, wherein said work stand support device includes a device capable of shifting a center of gravity of said work stand to a front thereof by slidable relocation of said work stand with respect to said body after said work stand is positioned nearly horizontally on the slope by pivoting thereof relative said body.

17. A slope working machinery comprising:

a body;

a running device capable of travel on a slope, said running device being attached to said body;

a work stand positioned to the upper part of said body;

a work stand support device mounted between said body and said work stand for positioning said work stand nearly horizontally;

a working device, for the slope, mounted on said work stand; and a suspension device for providing suspended support of said body from an upper position on the slope to maintain a condition of said body, said suspension device including left and right winches mounted on both sides of said body and which include wires, and left and right anchor pins fixed to left and right portions of an upper part of the slope, capable of attaching to the wires of said left and right winches.

18. A slope working machinery comprising:

a body;

a running device capable of travel on a slope, said running device being attached to said body;

a work stand positioned to the upper part of said body;

a work stand support device mounted between said body and said work stand for positioning said work stand nearly horizontally;

a working device, for the slope, mounted on said work stand; and a suspension device for providing suspended support of said body from an upper position on the slope to maintain a condition of said body, said suspension device including left and right winches mounted on both sides of the upper position on the slope, and left and right wire fixation clasps mounted on both sides in front of said body, to which a projection fixed to the end of the wire rolled up by said left and right winches are fixably engageable.

19. A slope working machinery comprising:

a body;

a running device capable of travel on a slope, said running device being attached to said body;

a work stand positioned to an upper part of said body;

a work stand support device mounted between said body and said work stand for positioning said work stand nearly horizontally; and a suspension device including at least one winch including a wire supportably extending between said body and an upper position on the slope for sustaining a condition of said body, said suspension device including left and right winches mounted on both sides of said body, and left and right anchor pins fixed to left and right portions of the upper position on the slope, said pins being capable of attaching to the wires of said left and right winches.

20. A slope working machinery comprising:

a body;

a running device capable of travel on a slope, said running device being attached to said body;

a work stand positioned to an upper part of said body;

a work stand support device mounted between said body and said work stand for positioning said work stand nearly horizontally; and a suspension device including at least one winch including a wire supportably extending between said body and an upper position on the slope for sustaining a condition of said body said suspension device including left and right winches mounted on both sides of the upper position on the slope, and left and right wire fixation clasps mounted on both sides in a front of said body, to which a projection fixed to the end of the wire rolled up by said left and right winches is fixably engageable.

* * * * *